US010185265B2

(12) United States Patent
Chiyoda

(10) Patent No.: US 10,185,265 B2
(45) Date of Patent: Jan. 22, 2019

(54) IMAGE FORMING APPARATUS THAT PERMITS OR PROHIBITS A CALIBRATION PROCESS DEPENDING ON A TYPE OF A MOUNTED FIXING DEVICE

(71) Applicant: CANON KABUSHIKI KAISHA, Tokyo (JP)

(72) Inventor: Yasuharu Chiyoda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/903,561

(22) Filed: Feb. 23, 2018

(65) Prior Publication Data

US 2018/0181047 A1 Jun. 28, 2018

Related U.S. Application Data

(62) Division of application No. 15/693,744, filed on Sep. 1, 2017.

(30) Foreign Application Priority Data

Sep. 12, 2016 (JP) ..... 2016-177991
Jun. 30, 2017 (JP) ..... 2017-129353

(51) Int. Cl.
*G03G 15/20* (2006.01)
*G03G 15/00* (2006.01)
*G03G 21/16* (2006.01)

(52) U.S. Cl.
CPC ..... *G03G 15/5016* (2013.01); *G03G 15/5062* (2013.01); *G03G 21/1685* (2013.01);
(Continued)

(58) Field of Classification Search
CPC ..... G03G 15/5016; G03G 21/1685; G03G 2215/00514; G03G 2221/1639; G03G 15/5062; G03G 2215/00042
(Continued)

(56) References Cited

U.S. PATENT DOCUMENTS 6,016,409 A * 1/2000 Beard ..... G03G 15/2064 399/110
8,090,273 B2 * 1/2012 Derimiggio ..... G03G 15/50 399/12

(Continued)

FOREIGN PATENT DOCUMENTS

JP 2008-058365 A 3/2008
JP 2009063629 A * 3/2009 ..... G03G 15/2064

(Continued)

OTHER PUBLICATIONS

Extended European Search Report dated Mar. 14, 2018, issued in European Patent Application No. 17188088.3.

*Primary Examiner* — Robert Beatty
(74) *Attorney, Agent, or Firm* — Fitzpatrick, Cella, Harper & Scinto

(57) ABSTRACT

An image forming apparatus includes a correcting portion to correct gradation of inputted image data on the basis of a correction condition, an image forming device to form, on a recording material, a toner image corresponding to the corrected image data, a mounting portion, an executing portion to execute an output process for forming and outputting, on the recording material, a predetermined toner image for generating the correction condition, the predetermined toner image including a plurality of image regions different in density, an input portion to permit input of an execution instruction of the output process by an operator, and a controller to control notification of information to the operator. The controller provides notification prompting exchange of the fixing portions in certain cases.

18 Claims, 18 Drawing Sheets

(52) U.S. Cl.
CPC ..... *G03G 2215/00042* (2013.01); *G03G 2215/00514* (2013.01); *G03G 2221/1639* (2013.01)

(58) Field of Classification Search
USPC ..... 399/45, 49, 81, 122
See application file for complete search history.

(56) References Cited

U.S. PATENT DOCUMENTS

| | | | | |
|---|---|---|---|---|
| 8,559,838 | B2 * | 10/2013 | Ogawahara | G03G 15/206 399/12 |
| 9,857,762 | B2 * | 1/2018 | Tanaka | G03G 21/1685 |
| 2004/0240893 | A1 * | 12/2004 | Sato | G03G 15/5075 399/8 |
| 2009/0317149 | A1 | 12/2009 | Takura | |
| 2011/0058201 | A1 * | 3/2011 | Mueller | G03G 15/50 358/1.13 |
| 2012/0076510 | A1 * | 3/2012 | Mizuno | G03G 15/20 399/12 |
| 2013/0100467 | A1 | 4/2013 | Miyazaki | |
| 2013/0142534 | A1 | 6/2013 | Isobe et al. | |
| 2015/0346654 | A1 | 12/2015 | Saito et al. | |

FOREIGN PATENT DOCUMENTS

| | | | |
|---|---|---|---|
| JP | 2010256638 | A * | 11/2010 |
| JP | 2015-060065 | A | 3/2015 |

* cited by examiner

IMAGE DENSITY ADJUSTMENT

CALIBRATION EXECUTION

UNSUITABLE FIXING DEVICE IS MOUNTED AT PRESENT.
CALIBRATION CANNOT BE EXECUTED BY THIS FIXING DEVICE.

CANCEL

Fig. 17

IMAGE DENSITY ADJUSTMENT

CALIBRATION EXECUTION

CALIBRATION CANNOT BE EXECUTED BY FXING DEVICE FOR ENVELOPE DUE TO INACCURATE DENSITY.

EXCHANGE TO NORMAL FIXING DEVICE FOR CALIBRATION ?

EXCHANGE STOP

Fig. 18

| KIND OF F. D. | F. D. SETTING | | MEDIA | | |
|---|---|---|---|---|---|
| | N. PRSSR | N. WDT | P. P. | T. P. | ENV. |
| GENERAL | NORMAL | NORMAL | ○ | ○ | △ |
| ENVELOPE | WEAK | NARROW | △ | X | ○ |

Fig. 23

IMAGE FORMING APPARATUS THAT PERMITS OR PROHIBITS A CALIBRATION PROCESS DEPENDING ON A TYPE OF A MOUNTED FIXING DEVICE

This application is a divisional application of U.S. patent application Ser. No. 15/693,744, filed Sep. 1, 2017, which claims the benefit of Japanese Patent Application No. 2016-177991 filed on Sep. 12, 2016, and No. 2017-129353 filed on Jun. 30, 2017, each of which is incorporated by reference herein in its entirety.

FIELD OF THE INVENTION AND RELATED ART

The present invention relates to an image forming apparatus of an electrophotographic type.

In the image forming apparatus of the electrophotographic type, there is a liability that a density of an image to be outputted fluctuates due to a lowering in toner charge amount or a fluctuation in ambient environment of the image forming apparatus. Therefore, Japanese Laid-Open Patent Application (JP-A) 2015-60065 discloses a constitution in which a test pattern is formed on a recording material and is subjected to measurement of a density thereof, and a gradation correction table is prepared.

Further, in a case in which a toner image formed on envelope media forming a bag-like member, including a plurality of superposed sheets, is fixed under application of heat and pressure, it has been known that there is a liability that creases, deviation of flap fold, and the like, is generated on the envelope media by a feeding the envelope media in a fixing device. JP-A 2008-58365 discloses a constitution in which a fixing device for plain paper and a fixing device for an envelope (fixing device for envelope) are prepared and in which the fixing device meeting a kind of a recording material (transfer-receiving material) used in printing is mounted and is subjected to image formation.

In the fixing device for an envelope, however, in order to suppress the generation of the creases on the envelope media, a pressure exerted on a nip is designed so as to be lower than that in a general-purpose fixing device. For that reason, in a calibration process for determining a condition for a gradation correction by measuring the density of the test pattern formed on the recording material, when the test pattern formed on a sheet-like recording material is fixed using the fixing device for an envelope, there is a liability that the following problem occurs. That is, in some cases, melting non-uniformity of a toner surface layer generates, so that there is a liability that a density particularly at a high-density portion is unstable.

Further, the envelope media include a portion where sheets are bonded to each other, and a flap, and therefore, for a single envelope, the number of superposed sheets is different depending on a position (portion). For that reason, when the test pattern is formed on the envelope media, depending on a position where the test pattern is formed, a difference generates in a manner of conduction of heat and pressure by fixing, so that there is a liability that a degree of a variation of the density of the test pattern becomes large.

Thus, in the image forming apparatus in which the general-purpose fixing device and the fixing device for an envelope are used selectively and replaceably with each other, when the calibration process regarding the gradation correction is executed using the fixing device for an envelope, there is a liability that accuracy of the gradation correction lowers.

SUMMARY OF THE INVENTION

A principal object of the present invention is to provide an image forming apparatus in which a plurality of fixing devices different in pressure exerted on a nip can be used in a replaceable manner, and that is capable of suppressing a lowering in accuracy of gradation correction.

According to one aspect, the present invention provides an image forming apparatus comprising a correcting portion configured to correct gradation of inputted image data on the basis of a correction condition, an image forming device configured to form, on a recording material, a toner image corresponding to the image data corrected by the correcting portion, a fixing device configured to fix, on the recording material, the toner image formed by the image forming device, a mounting portion configured to selectively mount one of a plurality of fixing devices, including a first fixing device including a pair of rotatable members forming a first nip under a first load and configured to fix, on the recording material in the first nip, the toner image formed by the image forming device, and a second fixing device including a pair of rotatable members forming a second nip under a second load smaller than the first load and configured to fix, on the recording material in the second nip, the toner image formed by the image forming device, a detector configured to detect a density of the toner image fixed on the recording material, and an executing portion configured to execute a calibration process for generating the correction condition on the basis of a result of detection of a predetermined toner image by the detector, wherein the predetermined toner image is a toner image that is formed, on the basis of predetermined data, on the recording material by the image forming device and that is fixed by the fixing device mounted in the mounting portion, and the predetermined toner image forms a plurality of image regions different in density, wherein the executing portion permits execution of the calibration process when the fixing device mounted in the mounting portion is the first fixing device, and prohibits the execution of the calibration process when the fixing device mounted in the mounting portion is the second fixing device.

According to another aspect, the present invention provides an image forming apparatus comprising a correcting portion configured to correct gradation of inputted image data on the basis of a correction condition, an image forming device configured to form, on a recording material, a toner image corresponding to the image data corrected by the correcting portion, a fixing device configured to fix, on the recording material, the toner image formed by the image forming device, a mounting portion configured to mount fixing devices, including the fixing device including a pair of rotatable members forming a second nip under a second load smaller than a first load and configured to fix, on the recording material in the second nip, the toner image formed by the image forming device, a detector configured to detect a density of the toner image fixed on the recording material, an executing portion configured to execute a calibration process for generating the correction condition on the basis of a result of detection of a predetermined toner image by the detector, wherein the predetermined toner image is a toner image that is formed, on the basis of predetermined data, on the recording material by the image forming device and that is fixed by the fixing device mounted in the mounting portion, and the predetermined toner image forms a plurality of image regions different in density, and a discriminating portion configured to discriminate whether or not the fixing device mounted in the mounting portion is a fixing device for an envelope, wherein the executing portion permits execution of the calibration process when the discriminating portion discriminates that the fixing device mounted in the mounting portion is not the fixing device for the envelope, and prohibits the execution of the calibration process using the fixing device for the envelope when the discriminating portion discriminates that the fixing device mounted in the mounting portion is the fixing device for the envelope.

According to yet another aspect, the present invention provides an image forming apparatus comprising a reading portion configured to read an image on an original, a correcting portion configured to correct gradation, of the image on the original read by the reading portion, on the basis of a correction condition, an image forming device configured to form, on a recording material, a toner image corresponding to the image data corrected by the correcting portion, a fixing device configured to fix, on the recording material, the toner image formed by the image forming device, a mounting portion configured to selectively mount one of a plurality of fixing devices, including a first fixing device including a pair of rotatable members forming a first nip under a first load and configured to fix, on the recording material in the first nip, the toner image formed by the image forming device, and a second fixing device including a pair of rotatable members forming a second nip under a second load smaller than the first load and configured to fix, on the recording material in the second nip, the toner image formed by the image forming device, and an executing portion configured to execute a calibration process for generating the correction condition on the basis of a result of reading of a predetermined toner image by the reading portion, wherein the predetermined toner image is a toner image that is formed, on the basis of predetermined data, on the recording material by the image forming device and that is fixed by the fixing device mounted in the mounting portion, and the predetermined toner image forms a plurality of image regions different in density, wherein the executing portion permits execution of the calibration process when the fixing device mounted in the mounting portion is the first fixing device, and prohibits the execution of the calibration process when the fixing device mounted in the mounting portion is the second fixing device.

According to a further aspect, the present invention provides an image forming apparatus comprising a correcting portion configured to correct gradation of inputted image data on the basis of a correction condition, an image forming device configured to form, on a recording material, a toner image corresponding to the image data corrected by the correcting portion, a fixing device configured to fix, on the recording material, the toner image formed by the image forming device, a mounting portion configured to selectively mount one of a plurality of fixing devices including a first fixing device capable of fixing the toner image on a predetermined kind of a recording material not including a predetermined envelope, and a second fixing device capable of fixing the toner image on a predetermined kind of a recording material including the predetermined envelope, a detector configured to detect a density of the toner image fixed on the recording material, and an executing portion configured to execute a calibration process for generating the correction condition on the basis of a result of detection of a predetermined toner image by the detector, wherein the predetermined toner image is a toner image that is formed, on the basis of predetermined data, on the recording material by the image forming device and that is fixed by the fixing device mounted in the mounting portion, and the predetermined toner image forms a plurality of image regions different in density, wherein the executing portion permits execution of the calibration process when the fixing device mounted in the mounting portion is the first fixing device, and prohibits the execution of the calibration process when the fixing device mounted in the mounting portion is the second fixing device.

Further features of the present invention will become apparent from the following description of exemplary embodiments with reference to the attached drawings.

BRIEF DESCRIPTION OF THE DRAWINGS

FIGS. 15 to 22 are schematic illustrations each showing an example of a UI display regarding the calibration process.

FIG. 23 is a table showing setting for each of fixing devices and a list of compatible media.

DESCRIPTION OF THE EMBODIMENTS

Preferred embodiments of the present invention will be described specifically with reference to the drawings. Constituent elements described in the embodiments are examples, however, and the present invention is not limited to only such specific examples.

Embodiment 1

[Structure of Image Forming Apparatus]

Figure 1:
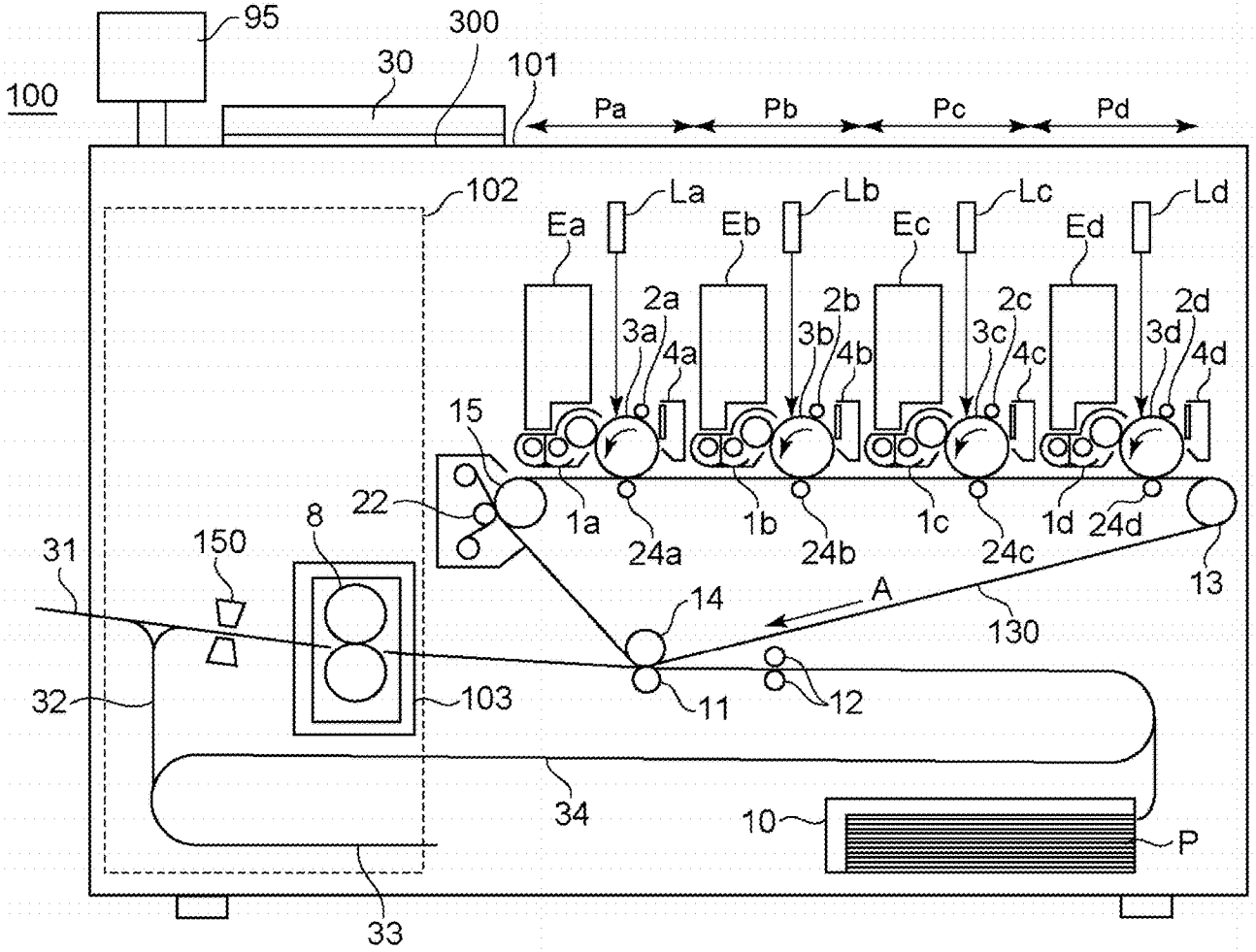
FIG. 1 is a sectional view showing an example of a structure of an image forming apparatus.

FIG. 1 is a sectional view showing an example of a structure of an image forming apparatus 100.

The image forming apparatus 100 in this embodiment is applicable to a copying machine, a printer, a facsimile machine, a multi-function machine having a plurality of functions of these machines, and the like.

The image forming apparatus 100 shown in FIG. 1 is a full-color image forming apparatus using an electrophotographic type (process), in which four stations Pa (yellow), Pb (magenta), Pc (cyan), and Pd (black) for forming toner images of four different colors are provided. Adjacent to these stations, an endless intermediary transfer belt 130, as an intermediary transfer member onto which the color toner images formed at the respective stations are to be transferred, is provided. These four stations Pa, Pb, Pc, and Pd have the same constitution, and, therefore, in the following, a structure (constitution) of the yellow station Pa will be described as a representative. Other stations are understood by adding the same reference numerals or symbols to constituent elements identical to those of the station Pa and by changing suffixes (a, b, c, d) representing associated stations (units).

A photosensitive drum 3*a*, as an image bearing member, is, for example, a cylindrical electrophotographic photosensitive member having a surface layer formed of an organic photo-semiconductor, and is rotationally driven in an arrow direction.

As a forming portion for forming the toner image on the photosensitive drum (image bearing member) 3*a*, a charging roller (charging portion) 2*a*, an exposure device (exposure portion) La, and a developing device (developing portion) la function. The charging roller 2*a*, is a charging means (charging portion) for electrically charging a surface of the photosensitive drum 3*a* to a uniform potential. The charging roller 2*a*, to which a predetermined bias is applied, is rotated by rotation of the photosensitive drum 3*a*, in a contact state with the photosensitive drum 1, and charges the surface of the photosensitive drum 3*a* to the predetermined potential. The exposure device La, as the exposure means (exposure portion), exposes the charged surface of the photosensitive drum 3*a* to light, so that an electrostatic latent image, corresponding to an image of a portion requiring yellow toner, of image information inputted from a scanner and an external terminal, is formed. In this embodiment, the exposure device La emits a laser light. The developing device 1*a*, as a developing means (developing portion), includes a developing container for accommodating a developer containing a toner and a carrier, feeding screws (two feeding screws in FIG. 1) for feeding the toner to a developing sleeve while stirring the developer in the developing container, and the developing sleeve. The developing device 1*a* develops the electrostatic latent image on the photosensitive drum 3*a* with the toner carried on the developing sleeve, so that the toner image corresponding to the electrostatic latent image is formed on the photosensitive drum 3*a*.

The toner image on the photosensitive drum 3*a* is fed to a primary transfer portion (transfer portion) by the rotation of the photosensitive drum 3*a* and is primary-transferred onto the intermediary transfer belt (intermediary transfer member) 130 under application of a primary transfer bias to a primary transfer roller 24*a*.

Primary transfer residual toner remaining on the photosensitive drum 3*a* without being primary-transferred is removed and collected by a cleaning device 4*a* having a blade, a brush, or the like. Then, the photosensitive drum 3*a*, from which the primary transfer residual toner is removed, is uniformly charged by the charging roller 2*a* again and is repetitively subjected to image formation.

The intermediary transfer belt 130 is stretched by a driving roller 15, a supporting roller 13, and a back-up roller 14. The intermediary transfer belt 130 is rotationally driven in an arrow A direction by rotation of the driving roller 15 while contacting the photosensitive drums 3*a*, 3*b*, 3*c*, and 3*d* of the four stations Pa, Pb, Pc, and Pd.

In a case in which a full-color mode (full-color image formation) is selected, an image forming operation is executed in each of the four stations Pa, Pb, Pc, and Pd. Then, the yellow toner image, the magenta toner image, the cyan toner image and the black toner image formed on the photosensitive drums 3*a*, 3*b*, 3*c*, and 3*d*, respectively, are successively transferred superposedly onto the intermediary transfer belt (intermediary transfer member) 130. The order of the transfer of the color toner images is not limited to the above order but may also be arbitrarily changed depending on the image forming apparatus used.

Then, the four color toner images successively and superposedly transferred to the intermediary transfer belt 130 are fed to a secondary transfer portion (transfer portion) where the back-up roller 14 and a secondary transfer roller 11 are provided opposed to each other via the intermediary transfer belt 130. At the secondary transfer portion, under application of a secondary transfer bias to the secondary transfer roller 11, the toner images are secondary-transferred from the intermediary transfer belt 130 onto a recording material P.

In this embodiment, the stations Pa, Pb, Pc, and Pd, the intermediary transfer belt 130, and, the secondary transfer portion function as an image forming portion 78 for forming an image on the recording material P.

The recording material P is a recording material on which the image is formed by the image forming apparatus 100 and, e.g., includes plain paper, thick paper, thin paper, and, in addition, an envelope, an OHP sheet, and the like. An accommodating cassette 10 is an accommodating portion for accommodating the recording material P. A single recording material P fed from the accommodating cassette 10 is fed to the secondary transfer portion by a feeding device including a registration roller pair 12 by being timed to the toner images, on the intermediary transfer belt 130, fed to the secondary transfer portion.

As seen in the rotational direction A of the intermediary transfer belt 130, at a position between the secondary transfer portion and the primary transfer portion of the station Pa, a cleaning device 22 for the intermediary transfer belt 130 is provided. In the cleaning device 22, a blade, a brush, a web (non-woven fabric), or the like, is provided, and removes and collects secondary transfer residual toner remaining on the intermediary transfer belt 130 without being secondary-transferred. The cleaning device 22 in FIG. 1 shows an example in which the web (non-woven fabric) is disposed. Then, the intermediary transfer belt 130, from which the secondary transfer residual toner is removed, is repetitively subjected to the image formation.

Incidentally, a constitution in which a plurality of accommodating cassettes 10 are provided, so that recording materials P can be accommodated for each of various kinds or sizes of recording material P, may also be employed. In this case, a CPU 81 (FIG. 4), as a controller, causes the feeding device to feed the recording material P from the accommodating cassette accommodating the recording material P to be subjected to printing, depending on the kind of the recording material P designated by a user in a print job (print instruction). Further, the image forming apparatus 100 may also employ a constitution in that the accommodating cassette that should be used in printing the print job is selected by the user in combination with input of the print job (print instruction).

In the print job, the CPU 81 receives, in addition to data of the image to be formed on the recording material P, various pieces of information, such as color number information, such that the image is printed in either of an operation in a color mode and an operation in a monochromatic mode, and the kind of paper (sheet) of the recording material P.

The image (toner image) formed on the recording material P by the above-described image forming portion 78, i.e., the toner image transferred on the recording material P at the secondary transfer portion, is fed to a fixing device 8. The fixing device 8 fixes, on the recording material P, unfixed toner images transferred on the recording material P at the secondary transfer portion under application of heat and pressure. The fixing device 8 is detachably mountable to a mounting portion 103 provided in a main assembly (casing) 101 of the image forming apparatus 100. A detailed structure of the fixing device 8 will be described later.

In the case of one-side printing, the recording material P passes through the fixing device 8 and, thereafter, passes through a feeding path 31, and then is discharged to a discharge tray provided in an outside of the image forming apparatus 100.

In the case of double-side printing, in order to form an image on a back surface, the recording material P, on which the toner image is fixed on a front surface, is fed to a feeding path 32 and is turned upside down (reversed) by a reversing path 33. Thereafter, the recording material P is fed to the secondary transfer portion again through a feeding path 34 for double-side printing, so that the toner image is formed and fixed on the back surface of the recording material P in a process similar to the above-described process.

Further, a front door 102, as an openable portion, is a door provided at an opening of the main assembly (casing) 101 of the image forming apparatus 100 in order to mount the fixing device 8 in the mounting portion 103.

The image forming apparatus 100 includes an opening/closing sensor (optical sensor) 76 (FIG. 4) as a sensor for detecting that the front door 102 is in a closed state. The opening/closing sensor 76 and the CPU 81 (FIG. 4) function as an opening/closing detecting portion. The front door 102 is provided with projections (unshown) and, by closing the front door 102, the projections are inserted into receiving portions (unshown) of the main assembly 101 of the image forming apparatus 100. With the insertion of the projections into the receiving portions, the CPU 81 detects that the front door 102 is closed, on the basis of a signal sent by the opening/closing sensor 76. On the other hand, when the signal from the opening/closing sensor 76 is not outputted, the CPU 81 detects that the front door 102 is open. The opening/closing sensor 76 may also have a constitution in which, with the opening of the front door 102, the CPU 81 detects that the front door 102 is open on the basis of the signal sent by the opening/closing sensor 76, and, on the other hand, when the signal from the opening/closing sensor 76 is not outputted, the CPU 81 detects that the front door 102 is closed may also be employed.

The image forming apparatus 100 includes a color sensor (developer or detecting portion) 150 for detecting the color of the image formed on the recording material P. In this embodiment, the color sensor 150 is provided in the main assembly 101 of the image forming apparatus 100 and is disposed in a position downstream of the fixing device 8 with respect to a feeding direction of the recording material P. The color sensor 150 measures the color of the image of a test pattern formed and fixed on the recording material P. Details of the color sensor 150 will be described later.

[Structure of Fixing Device]

Figure 3:
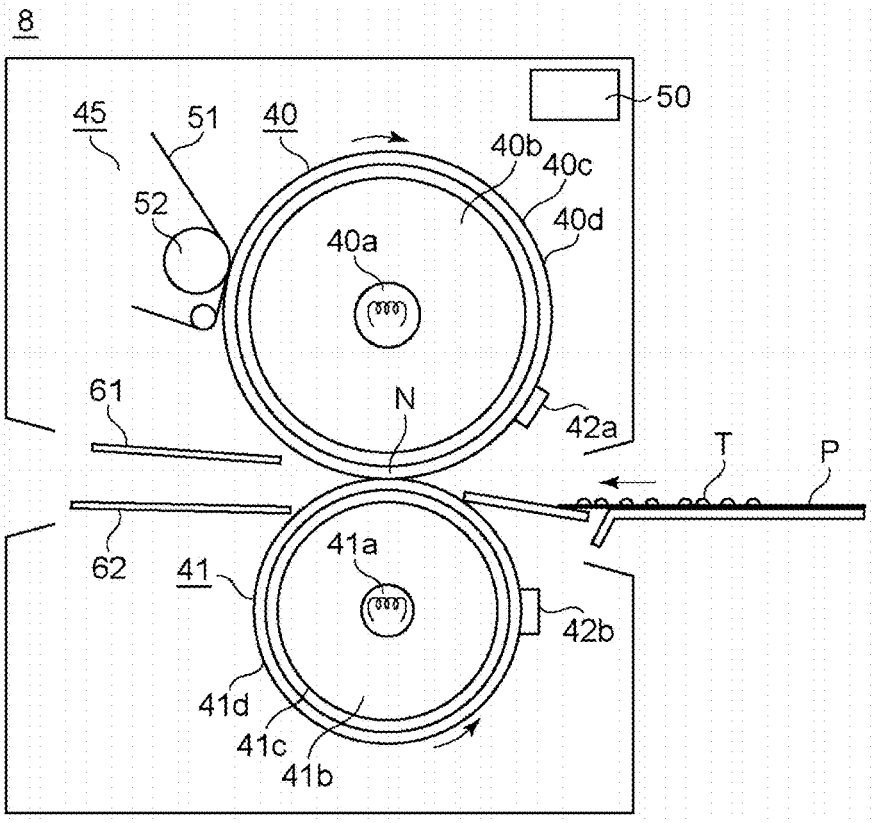
FIG. 3 is a sectional view showing an example of a structure of the fixing device.

A structural example of the fixing device 8 will be described. FIG. 3 is a sectional view showing an example of a structure of the fixing device 8. As described later, in the mounting portion 103, a plurality of fixing devices (8A, 8B) are mounted exchangeably, but in the following description, a structure common to the respective fixing devices will be described.

The image forming apparatus 100 employs a so-called oil-less fixing device 8 by using the toner containing a parting agent.

The fixing device 8 includes a fixing roller 40 as a rotatable heating member for heating the toner image on the recording material P in contact with the surface of the recording material P on which the (unfixed) toner image is formed. The fixing device 8 further includes a pressing roller (rotatable member) 41 that is a rotatable nip-forming member for forming a nip N in a cooperation with the fixing roller 40.

The fixing device 8 heats the fixing roller 40 by a heater 40*a* as a first heat source provided inside the fixing roller 40. The fixing device 8 nips and feeds the recording material P, through the nip N, on the surface on which the toner image is carried, and thus heats and presses the recording material P, so that the toner image is melted and fixed on the recording material P. The heater 40*a* is a halogen heater, for example. Specifically, the heater 40*a* is electrically connected with a heater controller 90 (FIG. 4) provided in the fixing device 8, and ON/OFF of the heater 40*a* is controlled by the heater controller 90 of the fixing device 8. A thermistor 42*a* is a temperature sensor for detecting a temperature of the surface of the fixing roller 40. Specifically, the thermistor 42*a* is electrically connected with a temperature detecting portion (detector) 89 (FIG. 4) provided in the fixing device 8, and detects the surface temperature of the fixing roller 40. The CPU 81 (FIG. 4), as the controller, controls the heater controller 90 of the fixing device 8 on the basis of the temperature detected by the temperature detecting portion 89 of the fixing device 8, and adjusts the temperature of the fixing roller 40 so as to be a predetermined temperature.

In this embodiment, the heater 40*a* heats the fixing roller 40 so that the surface of the fixing roller 40 can maintain, for example, a temperature of about 150° C. to 180° C. as the predetermined temperature at which the toner image is fixed on the recording material P. Specifically, the CPU 81 controls the heater 40*a* so that the surface temperature of the fixing roller 40 is a target temperature depending on the kind, or the like, of the recording material P.

In this embodiment, the heater 40*a* is provided inside the fixing roller 40, but the present invention is not limited thereto. For example, a constitution in which the fixing roller 40 is externally heated may also be employed.

In this embodiment, the heater 40*a* is constituted by the halogen heater, but the present invention is not limited thereto. For example, the heater may only be required so that it can heat the fixing roller 40 in such a constitution that the fixing roller 40 is heated through induction heating, for example.

The fixing roller 40 is formed by providing, on a hollow metal core shaft 40*b* as a base layer, an elastic layer 40*c* consisting of a rubber layer, and then by coating a parting layer 40*d* as a surface layer on the elastic layer 40*c*. The core shaft 40*b* is constituted by an aluminum member formed in a cylindrical shape of, e.g., 68 mm in outer diameter, and the heater 40*a* is disposed inside the core shaft 40*b*. The elastic layer 40*c* is constituted by a 1.0 mm-thick molded layer of a silicone rubber of, e.g., 20 degrees in JIS-A hardness. The parting layer 40*d* is constituted by a material, such as a fluorine-containing resin material, that is molded in a thickness of, e.g., 50 μm, that is excellent in parting property, and that is softened by temperature rise, and the parting layer 40*d* coats the elastic layer 40*c*. As the fluorine-containing resin material of the parting layer 40*d*, for example, tetrafluoroethylene-perfluoroalkylvinyl ether copolymer (PFA), polytetrafluoroethylene (PTFA), or the like, can be used. In this embodiment, as the parting layer 40*d*, a PFA resin tube was used. A thickness of the parting layer 40*d* as the surface layer of the fixing roller 40 may preferably be 30 μm to 100 μm, for example. Here, the shape of the parting layer 40*d* is not limited to the tube shape, but may also coat the elastic layer 40*c* by subjecting the elastic layer 40*c* to coating, for example.

Figure 4:
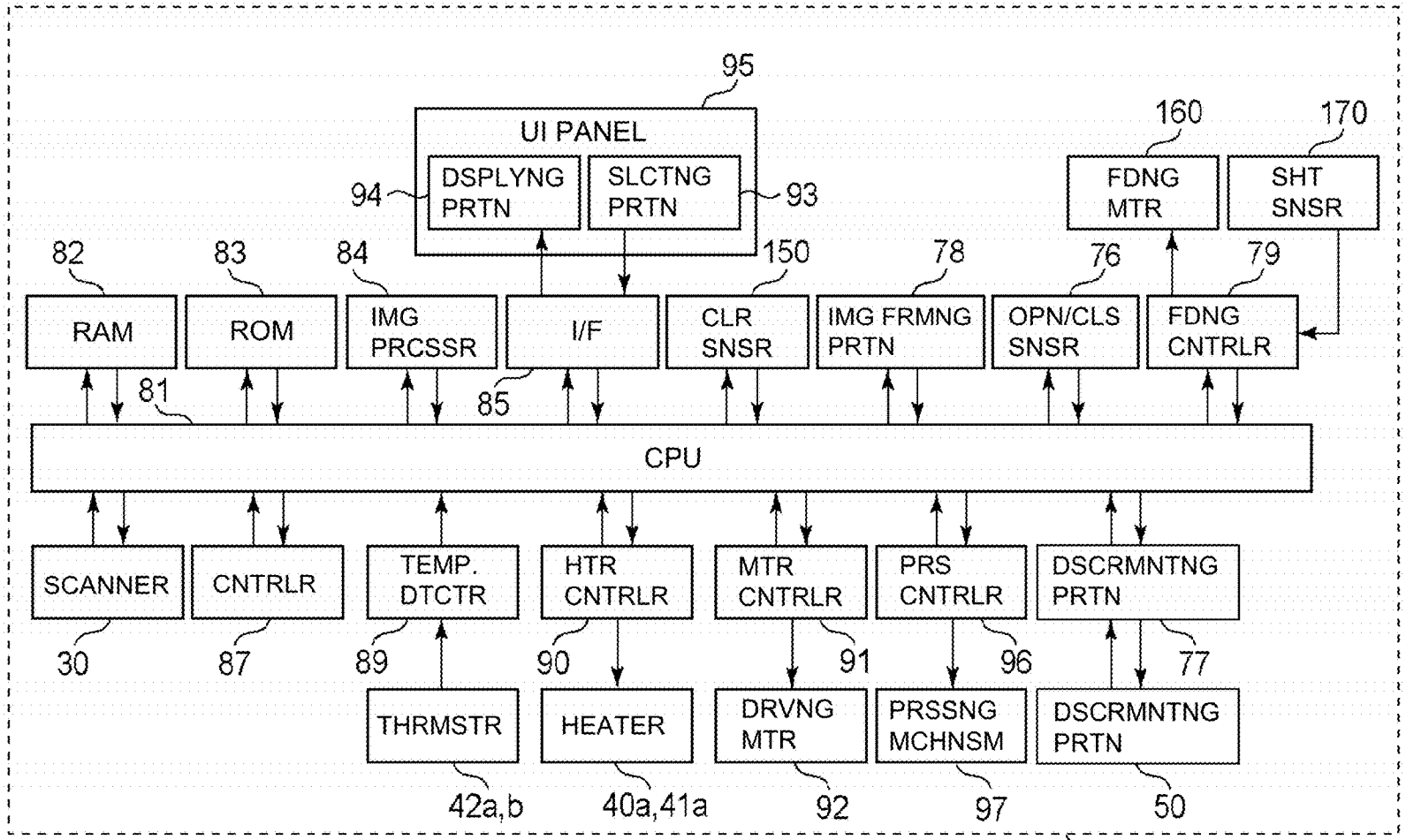
FIG. 4 is a block diagram showing an example of a control system of the image forming apparatus.

The fixing roller 40 is rotatably supported by supporting members (not shown) provided at end portions of the core shaft 40*b* with respect to a longitudinal direction (rotational axis direction), and is rotationally driven in an arrow direction in FIG. 3 by a motor 92 (FIG. 4). By being driven by the motor 92, the fixing roller 40 is rotationally driven at a speed such that the surface thereof moves at a rate of, e.g., 100 mm/sec (surface movement speed). The motor 92 is electrically connected with a motor controller 91 provided in the fixing device 8, and the CPU 81 controls the rotation of the motor 92 through the motor controller 91 of the fixing device 8. Incidentally, in the following, the surface movement speed of each of the rotatable members is also referred to as a peripheral speed.

The pressing roller 41 is formed by providing, on a hollow metal core shaft 41*b* as a base layer, an elastic layer 41*c* consisting of a rubber layer, and then by coating a parting layer 41*d* as a surface layer on the elastic layer 41*c*. The core shaft 41*b* is constituted by an aluminum member formed in a cylindrical shape of, e.g., 48 mm in outer diameter. The elastic layer 41*c* is constituted by a 2.0 mm-thick molded layer of a silicone rubber of, e.g., 20 degrees in JIS-A hardness. The parting layer 41*d* is constituted by a material, such as a fluorine-containing resin material, that is molded in a thickness of, e.g., 50 μm, and that is excellent in parting property, and the parting layer 40*d* coats the elastic layer 40*c*. Here, as regards a material and a constitution of coating the elastic layer 41*c*, the parting layer 41*d* is not limited to those in this embodiment similarly as in the case of the parting layer 40*d* of the fixing roller 40.

Further, also inside the pressing roller 41, a heater 41*a*, such as a halogen heater, is provided. The pressing roller 41 is a rotatable heating member for imparting heat to the recording material P from a back side (a surface opposite from a surface of the recording material P where an unfixed toner image is formed) of the recording material P. On the front surface of the pressing roller 41, a thermistor 42*b* for detecting a temperature of a surface of the pressing roller 41 is provided. Specifically, the heater 41*a* is electrically connected with a heater controller 90 (FIG. 4) provided in the fixing device 8, and ON/OFF of the heater 41*a* is controlled by the heater controller 90 of the fixing device 8. The thermistor 42*b* is electrically connected with a temperature detecting portion (detector) 89 (FIG. 4) provided in the fixing device 8, and detects the surface temperature of the pressing roller 41. The CPU 81 (FIG. 4), as the controller, controls the heater controller 90 of the fixing device 8 on the basis of the temperature detected by the temperature detecting portion 89 of the fixing device 8, and adjusts the temperature of the pressing roller 41 so as to be a predetermined temperature.

The pressing roller 41 is rotatably supported by supporting members (not shown) provided at end portions of the core shaft 41*b* with respect to the longitudinal direction (rotational axis direction).

At each of longitudinal end portions of the pressing roller 41, a pressing mechanism 97 of the fixing device 8 is provided. The pressing mechanism 97 includes pressing springs (not shown) as urging means for urging the supporting members of the pressing roller 41 toward the fixing roller 40. The pressing mechanism 97 further includes a contact-and-spacing mechanism for positioning the pressing roller 41 in a pressed state, in which the pressing roller 41 is contacted toward the fixing roller 40 with a predetermined pressure by compression of the pressing springs, and a spaced state, in which the pressing roller 41 is spaced from the fixing roller 40. In the pressed state, the pressing roller 41 is urged toward the fixing roller 40 by the pressing mechanism 97 provided at each of the longitudinal end portions, whereby the pressing roller 41 forms a nip N having a predetermined width with respect to the feeding direction of the recording material P in cooperation with the fixing roller 40. The CPU 81 (FIG. 4), as the controller, controls a pressing controller 96 of the fixing device 8, and thus switches the state of the pressing roller 41 between the pressed state and the spaced state. In this embodiment, the pressing mechanism 97 has a constitution of urging the pressing roller 41 toward the fixing roller 40, but a constitution of urging the fixing roller 40 toward the pressing roller 41 may also be employed.

The pressing roller 41 is contacted to the fixing roller 40 in the pressed state, and is rotatable with rotation of the fixing roller 40.

[Controller]

FIG. 4 is a block diagram showing an example of a control system of the image forming apparatus 100.

The image forming apparatus 100 includes the CPU (central processing unit) 81 for controlling an operation of the image forming apparatus 100. The image forming apparatus 100 further includes a Random Access Memory (RAM) 82 and a Read Only Memory 83, and the like.

The CPU 81, functioning as the controller, effects integrated control of an operation of an entirety of the image forming apparatus 100 by executing a control program stored in the ROM 83. An operation of a flowchart described later is executed by the CPU 81 on the basis of a control program stored in the ROM 83. The CPU 81 uses the RAM 82 as a work area for executing a process of the control program.

The RAM 82 is a nonvolatile memory and also functions as a memory (storing portion) for storing a gradation correction table, or the like.

The CPU 81 is electrically connected with, in addition to the RAM 82 and the ROM 83, various mechanisms to be controlled.

The CPU 81 is electrically connected with an operating portion 95. In this embodiment, the CPU 81 is connected with the operating portion 95 through an I/F portion 85. The operating portion 95, functioning as a receiving portion for receiving an instruction from the operator and a notifying portion for notifying the operator of information, includes a display portion 94 (e.g., a liquid crystal monitor) and a selecting portion 93 (e.g., a selecting key). The operating portion 95 may also be of a touch panel type, in which the display portion 94 also functions as the selecting portion 93. The operating portion 95 displays an operation state of the image forming apparatus 100 at the display portion 94 or receives an instruction from the user through the selecting portion 93. The control is carried out by the CPU (receiving controller, display controller) 81.

The I/F portion 85 receives input of information from an external device. For example, the I/F portion 85 is capable of receiving image data, which is an original of an image, to be subjected to an image forming process, from an external PC (personal computer) connected with the image forming apparatus 100 through a network, or the like.

The CPU 81 sends, to a controller 87, the image data inputted from the external device through the I/F portion 85. The controller 87 is a raster image processor for not only analyzing the image data inputted through the I/F portion 85, but also for developing the image data into bit map data. In a case in which the image data inputted through the I/F portion 85 are constituted by data of three color components of R (red), G (green), and B (blue), the controller 87 converts the image data to image data of yellow, magenta, cyan, and black. The CPU 81 acquires the image data (image data of yellow, magenta, cyan, and black) from the controller 87 and sends the image data to an image processing portion (correcting portion) 84 of the image forming apparatus 100.

The image forming apparatus 100 may also have a constitution in which a scanner portion (reading portion) 30 is provided that captures an original of paper medium as image data. The scanner portion 30 includes an original carriage (placing portion) 300 on which the original is placed by the operator, an original cover (cover portion) for shielding the placed original, and an original reading portion including a light source and a charged-coupled device (CCD) sensor that are used for reading image information of the original. Light emitted from the light source of the original reading portion is reflected by the original placed on the original carriage 300. The reflected light from the original is formed as an image on the CCD sensor through an optical system, such as a lens. The image reading portion is capable of acquiring read data corresponding to the original when the reflected light from the original is formed as the image on the CCD sensor. The read data are constituted by data of, e.g., three color components of R (red), G (green), and B (blue). The scanner portion 30 starts reading of the image information of the original placed on the original carriage 300 with input of an instruction of a copy start by the operator through the operating portion 95. The scanner portion 30 converts the read data into the image data of yellow, magenta, cyan, and black. The CPU 81 is electrically connected with the scanner portion 30 and acquires the image data (image data of yellow, magenta, cyan, and black) read by the scanner portion 30, and then sends the image data to the image processing portion (correcting portion) 84 of the image forming apparatus 100.

The image processing portion (correcting portion) 84 corrects gradation of the inputted image data, i.e., effects gradation correction of the inputted image data on the basis of a correction condition. In a case in which a state of the developer in the developing device 1*a*, or a temperature or a humidity in the image forming apparatus 100 changes, there is a possibility that a density characteristic (gradation characteristic) of the image formed by the image forming apparatus 100 fluctuates. Therefore, the image processing portion 84 converts an input value (image signal value) of the image data into a signal value at which a target density image is formed by the image forming portion 78, so that the density characteristic (gradation characteristic) of the image formed by the image forming portion 78 is an ideal density characteristic. Specifically, the image processing portion 84 converts the inputted image data on the basis of a gradation correction table (γLUT) (gradation correction condition or correction condition) stored in the RAM 82. The CPU 81 is electrically connected with the image processing portion 84. The CPU 81 acquires image data subjected to the gradation correction by the image processing portion 84.

The CPU 81 is electrically connected with the image forming portion 78 and controls the image forming portion 78. The CPU 81 causes the image forming portion 78 to form the image on the basis of the image data subjected to the gradation correction by the image processing portion 84. The image forming portion 78 includes the various mechanisms included in the stations Pa, Pb, Pc, and Pd, and mechanisms such as the primary transfer portions and the secondary transfer portion as described above.

In a state in which the fixing device 8 is mounted in the image forming apparatus 100, the CPU 81 is electrically connected with the respective controllers (the temperature detecting portion 89 of the fixing device 8, the heater controller 90 of the fixing device 8, the motor controller 91 of the fixing device 8, and the pressing controller 96 of the fixing device 8) of the fixing device 8. The CPU 81 controls the respective controllers of the fixing device 8, and thus controls a feeding speed of the recording material P, the temperatures of the fixing roller 40 and the pressing roller 41, the pressing and the spacing of the pressing roller 41, and the like, in the fixing device 8. The fixing device 8 is thus controlled by the CPU 81, so that the fixing device 8 executes a process for fixing the toner image on the recording material P.

The CPU 81 is electrically connected with a discriminating portion 77. The discriminating portion 77 is provided in the image forming apparatus 100. In the state in which the fixing device 8 is mounted in the image forming apparatus 100, the discriminating portion 77 is electrically connected with an identifying portion 50 of the fixing device 8, and the CPU 81 acquires information on the kind of the fixing device 8 indicated (identified) by the identifying portion 50. The CPU 81 acquires information corresponding to the kind of the fixing device 8, mounted in the mounting portion 103, from the discriminating portion 77.

The CPU 81 is electrically connected with a feeding controller 79 and controls feeding of the recording material P. Specifically, the feeding controller 79 is electrically connected with a feeding motor 160 and a sheet sensor 170. The feeding motor 160 includes motors provided for a feeding portion for feeding the recording material P from the accommodating cassette 10, a feeding device including the registration roller pair 12 and various flappers for switching the feeding paths, and the feeding controller 79 controls drive of the feeding motor 160. The sheet sensor 170 is a sensor for detecting the presence or the absence of the recording material P on the feeding path.

The CPU 81 is connected with the color sensor 150 and acquires a detection results of the color sensor 150.

The controllers may also have a constitution in which a plurality of control circuits independently provided for each of the functions (e.g., the correcting portion, the generating portion, the discriminating portion, and the like), or may also be constituted by a single control circuit.

<Fixing Device Replacing System>

Next, a replacing system of the fixing device 8 will be described. In recent years, due to diversification of customer's needs, it has been required that an image forming apparatus compatible with image formation on an envelope is provided. In order to obtain a high-quality product, a method in which a plurality of fixing devices different in purpose of use are prepared and are selectively used by replacing the fixing device 8, depending on the kind of the recording material P to be used for printing, or depending on the preference of the user, has been proposed. This method is referred in this embodiment as a fixing device replacing system. By using the image forming apparatus 100 in which the fixing device is replaced with a fixing device for which a setting compatible with the recording material P used is made, it becomes possible to meet (i.e., print on) many kinds of recording materials P by a single image forming apparatus 100.

In the mounting portion 103 of the image forming apparatus 100, a general-purpose fixing device 8A and a fixing device for an envelope 8B are mountable.

The general-purpose fixing device 8A has many compatible kinds of recording materials P, but is a fixing device that does not ensure image formation on the envelope.

The fixing device for an envelope 8B is a fixing device designed to ensure a pressure suitable for printing on a recording material P (specifically, an envelope) for forming a bag-like member including a plurality of superposed sheets. For example, when the envelope is fed through the fixing device 8 with a high nip pressure, there is a liability that creases generates on the envelope after fixing. This is because a difference in feeding speed generates between the front surface and the back surface of the envelope. Therefore, in a case in which the printing is carried out on the envelope, as the fixing device 8, the fixing device for an envelope 8B constituted so that a pressure suitable for the envelope is applied to the nip N is used. The fixing device for an envelope 8B is small in pressure applied to the nip N, and, therefore, stress exerted on the envelope in the nip N is alleviated, so that the creases can be suppressed. A detailed difference between the general-purpose fixing device 8A and the fixing device for an envelope 8B will be described later.

FIG. 23 is a table showing a list of a fixing device setting and a compatible media for each of the fixing devices. Symbols (marks) in items of the compatible media, including plain paper ("P.P."), thick paper ("T.P."), and an envelope ("ENV"), in FIG. 23 have the following meanings: "○" represents that a quality of the recording material P after the fixing is ensured, "Δ" represents that the toner (toner image) can be fixed on the recording material P by the fixing device 8, but there is a liability that defects, such as uneven glossiness, creases, and the like, generate, and "x" represents that there is a liability that the toner cannot be fixed on the recording material P by the fixing device P, and, therefore, the use of the recording material P is not recommended.

In the case of the fixing device for an envelope 8B, when the thick paper (sheet having a basis weight exceeding about 180 g/m$^2$) is used as the recording material P, there is a liability that a heat quantity supplied to the toner is insufficient. For that reason, there is a liability that inconveniences, such as a cold offset such that the toner is offset toward the fixing roller 40 side, and a lowering in gloss property due to a roughened surface property without sufficient fusion of the toner, may occur.

Figure 2:
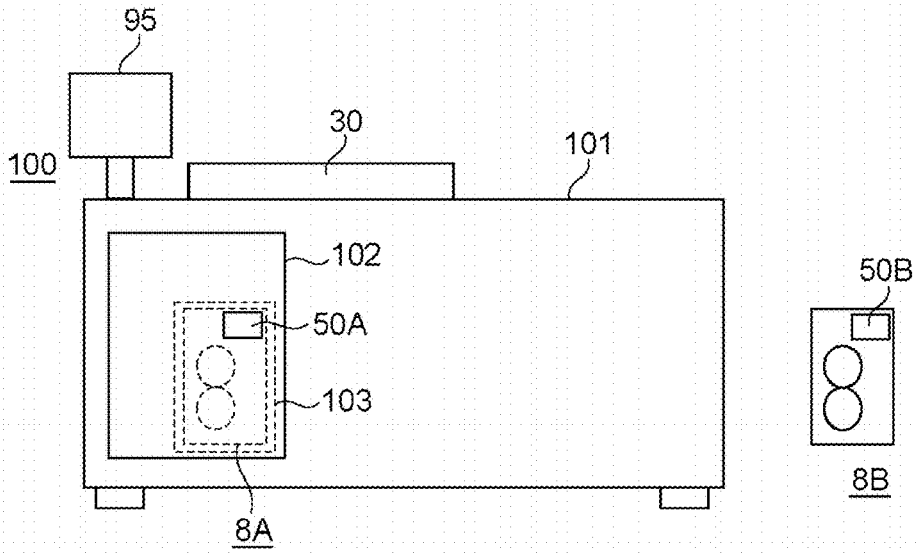
FIG. 2 is a schematic view for illustrating a replacing system of a fixing device.

In a case in which the operator intends to satisfactorily fix the toner on the envelope, the operator mounts, in the mounting portion 103, the fixing device for an envelope 8B that is reduced in pressure applied to the nip N compared with the general-purpose fixing device 8A, and uses the image forming apparatus 100 in a state in which the fixing device for an envelope 8B is mounted in the mounting portion 103. In a case in which the fixing device 8 is exchanged (replaced), the operator opens the front door 102 and demounts the fixing device 8 that has already been mounted in the image forming apparatus 100. Then, the operator mounts, in the mounting portion 103 of the image forming apparatus 100, a fixing device 8 different from the demounted fixing device 8, and then closes the front door 102. FIG. 2 is a schematic view for illustrating the fixing device replacing system, and shows a state in which the general-purpose fixing device 8A is mounted in the mounting portion 103.

Thus, a plurality of fixing devices 8 for which setting corresponding to the kind of the recording material P are prepared and are used in a replaceable manner depending on the kind of the recording material P to be subjected to the printing, or depending on preference of the user, so that the image forming apparatus 100 is able to meet (i.e., to print on) more kinds of the recording material P.

The fixing device for an envelope 8B is capable of performing a suitable fixing process on a predetermined kind of the recording material P including a predetermined envelope. The general-purpose fixing device 8A is capable of performing a suitable fixing process on a predetermined kind of the recording material P not including the predetermined envelope.

The image forming apparatus 100 in this embodiment does not prohibit execution of the fixing process on the envelope during mounting of the general-purpose fixing device 8A. As another embodiment, however, a constitution in which the fixing process on the predetermined envelope is not permitted in the general-purpose fixing device 8A may also be employed. That is, a constitution in which the general-purpose fixing device 8A is a fixing device capable of fixing the toner on the predetermined kind of the recording material P not including the predetermined envelope, and the fixing device for an envelope 8B is a fixing device capable of fixing the toner on the predetermined kind of the recording material P including the predetermined envelope may also be employed.

[Fixing Device for Envelope]

The envelope has a box-like shape such that a plurality of paper materials are superposed, and, therefore, compared with a single sheet-like recording material P, creases are liable to generate by the fixing process. In order to carry out satisfactory fixing, in the fixing device for an envelope 8B, the shape of the pressing roller 41 and the pressure in the nip N are changed to those suitable for the envelope.

The general-purpose fixing device 8A is designed to have a pressing force (pressure) of 800 N. That is, the general-purpose fixing device 8A includes a pressing mechanism 97 including a pressing spring for the pressing force of 800 N. By a predetermined load exerted on at least one of the fixing roller 40 and the pressing roller 41 by the pressing mechanism 97, the fixing roller 40 and the pressing roller 41 form the nip N. The general-purpose fixing device 8A is designed to have a nip N having a width of about 14 mm with respect to the feeding direction of the recording material P. In the general-purpose fixing device 8A, the fixing process on the recording material P is executed in a state in which the surface temperature of the fixing roller 40 is 170° C. Specific numerical values of the pressing force, the width of the nip N, and the temperature are examples, and are not limited to those described above.

In this condition, when the fixing process on the envelope is executed by the general-purpose fixing device 8A, although the fixing property is satisfactory, creases generate on the envelope. As regards the generation of the creases, there is sensitivity to the pressing force in the nip N. In order to suppress the generation of creases, a total pressure (pressing force) in the nip N of the fixing device for an envelope 8B may preferably be made not more than one half of a total pressure (pressing force) in the nip N of the general-purpose fixing device 8A. In the constitution in this embodiment, when the pressing force is 200 N, physical stress exerted on the envelope is sufficiently alleviated, so that the generation of creases can be suppressed.

Therefore, the fixing device for an envelope 8B is designed to have a pressing force (e.g., 200 N) less than the pressing force of the general-purpose fixing device 8A. That is, the fixing device for an envelope 8B includes a pressing mechanism 97 including a pressing spring for the pressing force of 200 N. The fixing device for an envelope 8B is designed to have a nip N having a smaller width (e.g., about 6 mm) with respect to the feeding direction of the recording material P than the width of the nip N of the general-purpose fixing device 8A. In order to compensate for a heat quantity decrease due to light pressure in the nip N, in the fixing device for an envelope 8B, the fixing of the toner on the envelope is carried out at a temperature (e.g., 180° C.), as the surface temperature of the fixing roller 40, that is greater than a fixing temperature in the general-purpose fixing device 8A.

That is, in the general-purpose fixing device 8A, the fixing roller 40 and the pressing roller 41 form the nip N by a first load. On the other hand, in the fixing device for an envelope 8B, the fixing roller 40 and the pressing roller 41 form the nip N by a second load that is less than the first load.

Here, the pressing force of the fixing device 8 refers to the total pressure exerted on the nip N by the pressing mechanism 97 in a pressed state in which the pressure is exerted on between the fixing roller 40 and the pressing roller 41. The total pressure (pressing force) refers to a magnitude of a force exerted on an entirety of a nip region of the nip N. That is, the total pressure (pressing force) does not refer to a force (pressure, $N/m^2$) acting per unit area.

In general, a pressure discriminate (surface pressure distribution) of the nip N can be measured by the following method. In a state in which the fixing device 8 is not driven, a pressure measuring film exhibiting a color depending on a pressing amount when being pressed is sandwiched in the nip N and thus, the pressure discriminate can be measured. Or, a sheet changing in electrical resistance value when pressure is applied to the sheet as it is sandwiched in the fixing nip N at normal temperature and thus, the pressure distribution can be measured.

The total pressure (pressing force) at the nip N is an integrated value (total value) of the surface pressure distribution measured by these methods in the nip N. The fixing device for an envelope 8B is designed so that this integrated value is less than the integrated value in the general-purpose fixing device 8A.

In this embodiment, in a case in which a verification of the pressing force of each of the general-purpose fixing device 8A and the fixing device for an envelope 8B is carried out, the pressure distribution is measured using a surface pressure distribution measurement system ("I-SCAN", manufactured by NITTA Corp.). The measurement of the pressure discriminate for the verification is carried out at a normal temperature (15° C.)

Further, as regards a region in which the pressure distribution value in the nip N is integrated, regions with respect to a direction perpendicular to the feeding direction of the recording material P are compared with each other with the same width in each of the general-purpose fixing device 8A and the fixing device for an envelope 8B. Specifically, with respect to the direction perpendicular to the feeding direction of the recording material P, the region is a region in which a maximum-sized envelope (recording material P) of envelopes on which the toner is fixable in the fixing device for an envelope 8B. When the width is X, also in the general-purpose fixing device 8A, the pressure distribution value in the region having the width X is integrated. Further, as regards the region in which the pressure discriminate value in the nip N is integrated, in the region with respect to the feeding direction of the recording material P, the pressure distribution value in the region in which the nip N is actually formed in each of the fixing devices 8 is integrated. For example, in this embodiment, in the general-purpose fixing device 8A, the pressure distribution value corresponding to about 14 mm in width is integrated, and, in the fixing device for an envelope 8B, the pressure distribution value corresponding to about 6 mm in width is integrated.

In the case of a constitution in which the pressure force in the general-purpose fixing device 8A or the fixing device for an envelope 8B can be switched to a plurality of pressing forces in the pressed state, a comparison is made at the lowest pressing force actually used in the fixing process in each of the fixing devices 8. Here, the lowest pressing force actually used in the fixing process is a pressure maintained under application of heat and pressure to the recording material P and does not mean 0 N in an unpressed state (a spaced state or a pressure temporarily and weakly applied during the transfer from the pressed state to the spaced state).

Further, the width of the nip N refers to a width of the nip N with respect to the feeding direction of the recording material P at position where the recording material P is capable of passing through a center of a maximum width with respect to the longitudinal direction of the fixing roller 40.

[Identification of Fixing Device]

In order that the CPU 81 acquires whether the kind of the fixing device 8 currently mounted in the mounting portion 103 is the general-purpose fixing device 8A or the fixing device for an envelope 8B, the general-purpose fixing device 8A includes an identifying portion 50A and the fixing device for an envelope 8B includes an identifying portion 50B. In this embodiment, each of the identifying portion 50A and the identifying portion 50B is a nonvolatile memory (storing portion) represented by an Electrically Erasable Programmable Read-Only Memory (EEPROM), a flash memory, or the like.

At the identifying portion 50A provided on the general-purpose fixing device 8A, information indicating that the fixing device is the general-purpose fixing device 8A is stored in advance. At the identifying portion 50B provided on the fixing device for an envelope 8B, information indicating that the fixing device is the fixing device for an envelope 8B is stored in advance. A discriminating portion (acquiring portion) 77 acquires information indicated by the identifying portion 50 of the fixing device 8 currently mounted in the mounting portion 103.

The information stored in the identifying portion 50 may only be required to be information by which the discriminating portion 77 discriminates a difference in constitution of the fixing device 8. For example, the information may also be information indicating the use of the fixing device 8, such as "general purpose" for the identifying portion 50A, or "for envelope" for the identifying portion 50B, or information indicating the pressing force in the nip N, such as "800N" for the identifying portion 50A, or "200N" for the identifying portion 50B.

In this embodiment, as the identifying portion 50, the memory was used, but the constitution of the identifying portion 50 is not limited thereto when the constitution is such that the CPU 81 can acquire whether the kind of the fixing device 8 currently mounted in the mounting portion 103 is the general-purpose fixing device 8A or the fixing device for an envelope 8B. For example, the identifying portion 50 may also be a dip switch or a resistor. Specifically, in a case in which the identifying portion 50 is the dip switch including a plurality of switches, a switch different depending on the use of the fixing device 8 is placed in a ON state in advance. The switch in the ON state outputs a signal to the discriminating portion 77 in response to an input signal from the discriminating portion 77. The discriminating portion 77 discriminates the fixing device 8 by detecting the signal from the switch in the ON state. For example, when the signal is inputted to first and second switches, the discriminating portion 77 discriminates that the fixing device 8 is the general-purpose fixing device 8A in a case in which the discriminating portion 77 detects an output signal of the first switch, and discriminates that the fixing device is the fixing device for envelope 8B in a case in which the discriminating portion 77 detects an output signal of the second switch.

[Gradation Correction and Calibration of Gradation Correction Condition]

Figure 5:
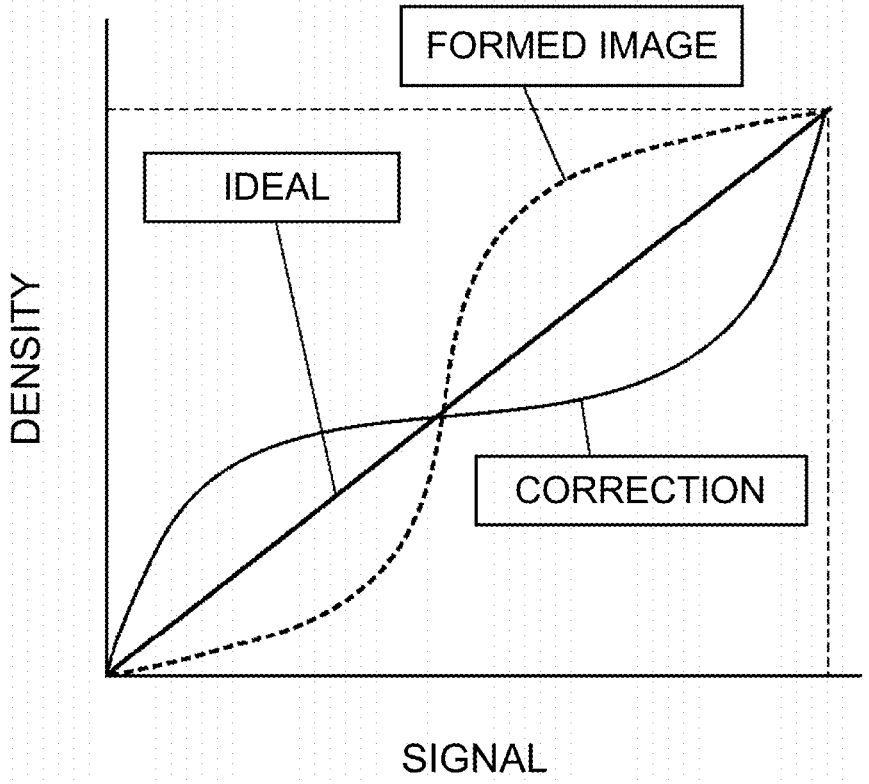
FIG. 5 is a conceptive view for illustrating gradation correction.

The image forming apparatus 100 carries out the gradation correction in order to effect image formation at a proper density with respect to an inputted original image. FIG. 5 is a conceptive view for illustrating the gradation correction, and shows correspondence between a signal value inputted to the image forming portion 78 and a density value of the image formed by the image forming apparatus 100. An ideal gradation characteristic is represented by a (solid) rectilinear line in FIG. 5, and a gradation characteristic of the image formed by the image forming apparatus 100 is represented by a broken line in FIG. 5. A gradation correction table (a curve represented by a solid line (curve)), showing a correction condition (correction condition) is a conversion table for correcting the gradation characteristic of the broken line to the ideal gradation characteristic (the rectilinear line in FIG. 5). This gradation correction table is stored in the RAM 82. The image data inputted to the image processing portion 84 is corrected on the basis of the gradation correction table by the image processing portion 84. The image forming portion 78 effects image formation on the basis of an output value (output data) converted on the basis of the gradation correction table. When this gradation correction table is not proper, there is a liability that a smooth gradation change cannot be realized.

In the image forming apparatus 100 of the electrophotographic type, even when the signal value inputted to the image forming portion 78 is the same, in some cases, an amount (amount per unit area) of the toner actually carried on the recording material P fluctuates depending on a state of the developer in the developing device 1*a*, or a temperature or a humidity in the image forming apparatus 100. For that reason, it has been known that the density (optical density) of the image on the recording material P as an output product (deliverable) changes. For example, a toner charge amount varies depending on a fluctuation in ambient environment (e.g., temperature or humidity) of the toner, so that, even when the same developing bias is applied, the amount of the toner used for developing the electrostatic latent image on the photosensitive drum 3*a* fluctuates.

Therefore, in the image forming apparatus 100, in order to address the fluctuation in density of the image on the recording material P, calibration for preparing or modifying the gradation correction table can be carried out. Specifically, the CPU 81 forms, as an image for the calibration, a test pattern provided with a plurality of gradation levels (plurality of regions) on recommended paper (e.g., quality paper having a basis weight of about 64 gsm to 100 gsm and an A3 size or more) by using a single color toner.

Then, the color of the test pattern is detected by the color sensor 150, and the density (optical density) of the image actually formed on the recording material P is measured. Specifically, the CPU 81 acquires density information on the basis of a measurement result of the color sensor 150. That is, the CPU 81 and the color sensor 150 function as a detecting portion. Incidentally, the test pattern is similarly formed for each of the colors of yellow, magenta, cyan, and black.

The CPU (generating portion) 81 prepares the gradation correction table so as to correct a deviation amount between a measured density and a target density. The information acquired using the color sensor 150 by the CPU 81 may only be required to be information corresponding to the optical density. For example, luminance information is acquired from the color sensor 150, and, on the basis of the luminance information, the gradation correction table may also be prepared. In this case, the CPU 81 and the color sensor 150 function as a detecting portion for detecting the density. Thus, the gradation correction table is subjected to calibration. By executing the calibration, a lowering in accuracy of the gradation correction can be suppressed. In this calibration, the density of the test pattern formed on the recording material P is measured, and, therefore, it is possible to prepare a gradation correction table capable of performing gradation correction including a transfer characteristic at the secondary transfer portion.

Figure 6:
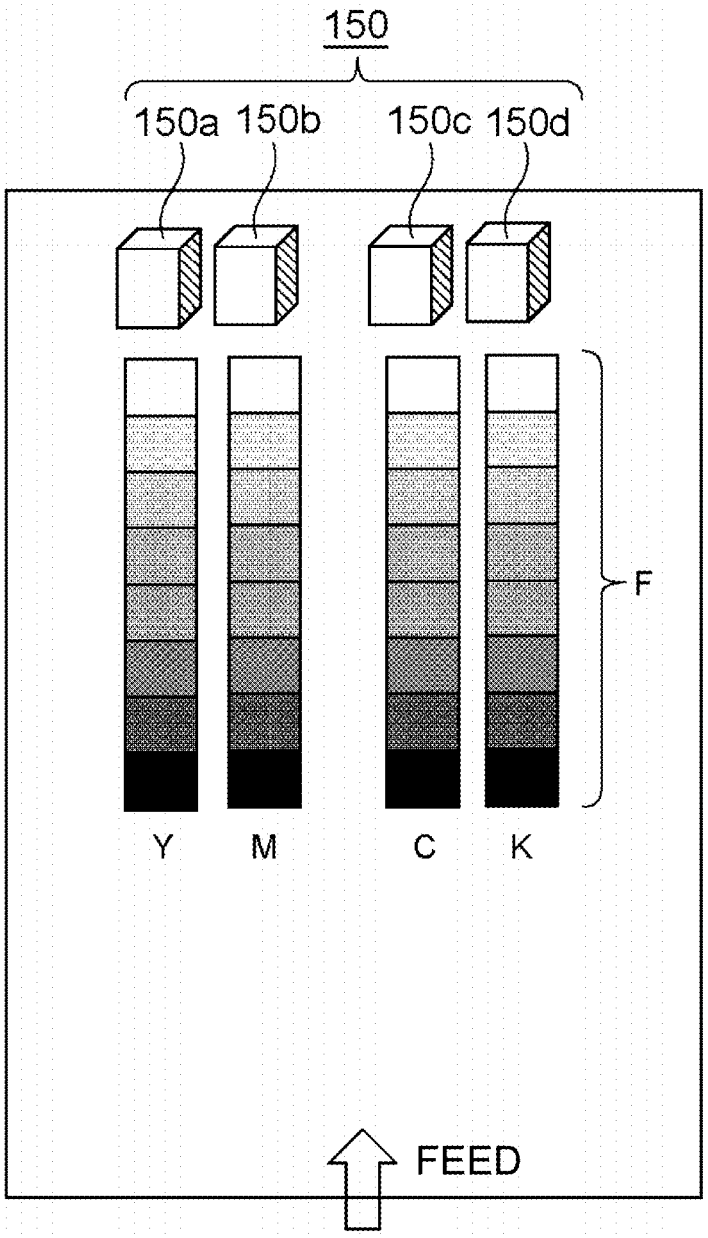
FIG. 6 is a schematic view showing an example of an arrangement of color sensors.
Figure 7:
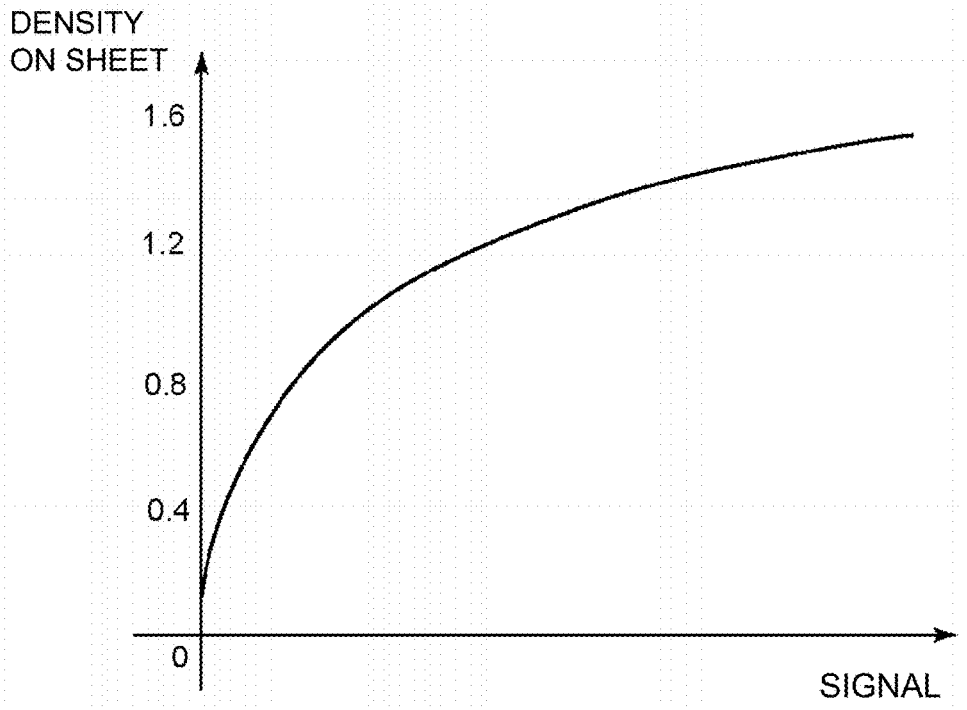
FIG. 7 is a graph showing a relationship between a signal value and a density.
Figure 8:
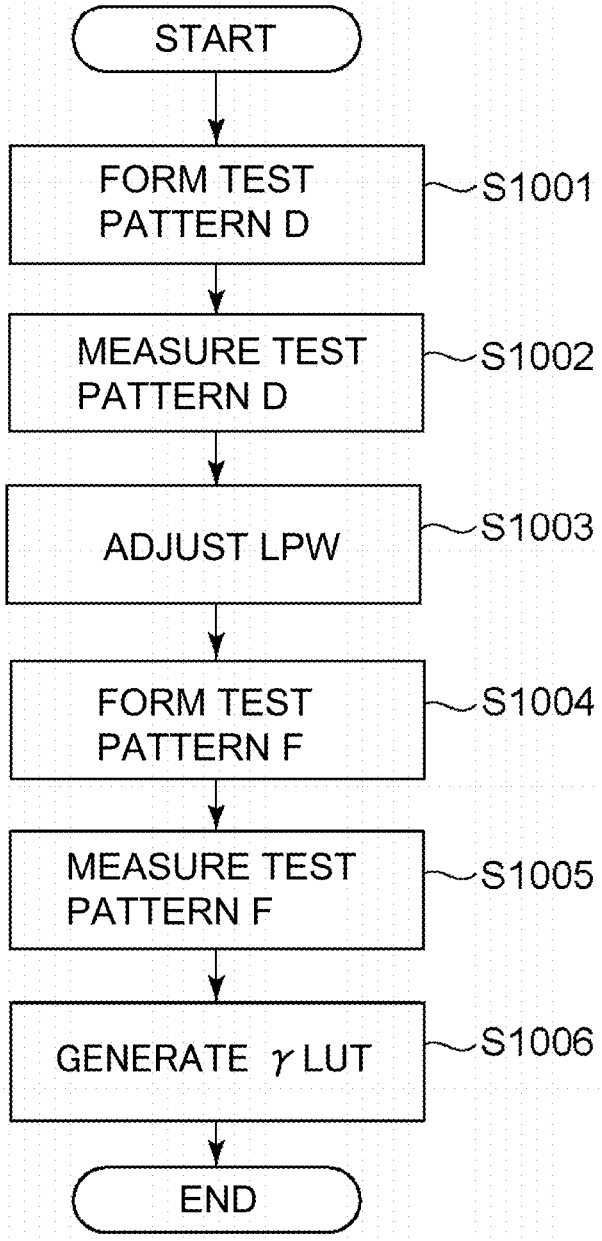
FIG. 8 is a flowchart regarding preparation of a gradation correction table.

With reference to FIGS. 6 to 8, a calibration process (hereafter, simply referred to as calibration) for preparing (generating) the gradation correction table will be described.

The CPU 81 functions as an executing portion for executing calibration shown in FIG. 8.

When the CPU 81 receives an execution instruction of the calibration process, the CPU 81 controls the image forming portion 78 to output a test pattern D that is an image used for maximum density adjustment (S1001). At this time, the test pattern D for the maximum density adjustment is formed on the recording material P with a charge potential, a laser intensity (exposure intensity) of the exposure device, and a developing bias that are set in advance or set in preceding (last) maximum density adjustment.

Thereafter, the CPU 81 causes the color sensor 150 to measure the test pattern D (S1002). The CPU 81 converts a measurement result of the test pattern D by the color sensor 150 into density data.

The CPU 81 adjusts the charge potential, the exposure intensity, and the developing bias so that the maximum density of the image to be outputted is a target maximum density (S1003). The image forming portion 78 uses, in a subsequent image forming operation and later, the charge potential, the exposure intensity, and the developing bias that are adjusted in S1003. Thus, the maximum density of the image to be outputted is adjusted. A method of adjusting the charge potential, the exposure intensity, and the developing bias is well known in the art, and, therefore, will be omitted from detailed description. In this embodiment, the exposure intensity (LPW) is adjusted in S1003. The CPU 81 acquires a correspondence relationship between the exposure intensity and the density on the basis of data measured by the color sensor (detecting portion) 150, and determines the exposure intensity such that it provides the target maximum density.

After the maximum density adjustment is executed, the CPU 81 controls the image forming portion 78, so that a plurality of test patterns F different in gradation levels as shown in FIG. 6 are formed on the recording material P (S1004). Specifically, for each of Y (yellow), M (magenta), C (cyan), and K (black), the CPU 81 inputs, to the image forming portion 78, signal values corresponding to eight image data different in gradation level. The image forming portion 78 forms, on the recording material P, patch images (each having a size of 12.7 mm×12.7 mm) corresponding to signal values different in gradation level by using the charge potential, the exposure intensity, and the developing bias that are adjusted in the maximum density adjustment. Positions of formation of the test patterns F on the recording material P are determined in advance, so that the test patterns F on the recording material P pass through measurement positions of the color sensor 150. The number of the test patterns F and a numerical value of the size of each of the test patterns F are examples and are not limited to those described above.

The color sensor 150 is a non-contact sensor of a reflection type. The color sensor 150 includes a light-emitting element for outputting white light, and a light-receiving element provided with an RGB on-chip filter. In this embodiment, the light-emitting element is provided in a position where the light is incident on the test pattern with an angle of 45 degrees with respect to a normal direction to the recording material P on which the test pattern D after fixing is formed. Further, the light-receiving element is provided so as to receive diffused reflection light reflected in the normal direction to the recording material P and measures R, G, and B values of the diffused reflection light. Further, the structures of the light-emitting element and the light-receiving element are not limited to those descried above, but may only be required that the light-receiving element receives the diffused reflection light (e.g., a constitution in which an incident angle is 0 degrees and a reflection angle of 45 degrees). Further, it is also possible to employ a constitution in which the color sensor 150 includes a light-emitting element for emitting light of each of three colors of R, G, and B, and a light-receiving element with no filter. The color sensor 150 outputs, to the CPU 81, luminance information of each of the test patterns of Y (yellow), M (magenta), C (cyan), and K (black) from the measured values of R, G, and B by using color information of complementary colors. Incidentally, as regards K, the color information of G is used.

In this embodiment, as shown in FIG. 6, four sensors 150*a* to 150*d* are disposed in the following positions with respect to a direction perpendicular to the feeding direction of the recording material P. That is, the color sensors 150*a* and 150*d* are disposed in positions each spaced from a center line of a (sheet) passing region by 80 mm, and the color sensors 150*b* and 150*c* are disposed in positions each spaced from the center line of the passing region by 30 mm. Here, the passing region is a region in which the recording material P on a feeding path is capable of passing through the region, and in the image forming apparatus 100, the recording material P is passed through the fixing device 8 on a center line sheet (paper) passing basis. The respective color sensors 150*a* to 150*d* detect the colors of the patch portions of Y, M, C, and K, respectively.

In this embodiment, as a detecting portion for detecting the colors of the test patterns, the R, G, and B color sensors were used, but the sensors are not limited thereto. A constitution using a spectral sensor including a white light source, diffraction grating, and a line sensor may also be employed. The white light source emits the light to the test pattern on the recording material P. The refraction grating spectrally disperses the light reflected from the test pattern for each wavelength. The line sensor 203 includes n light-receiving elements (n pixels). The spectral sensor outputs, to the CPU 81, light intensity values of the respective pixels of the line sensor.

The CPU 81 causes the color sensor 150 to measure the test patterns F (S1005). The CPU 81 converts a measurement result of the test patterns F by the color sensor 150 into density data. The CPU 81 acquires a relationship between a signal value corresponding to 8-gradation-basis image data inputted to the image forming portion 78 and a density of an image to be actually outputted (i.e., a gradation characteristic of the image forming portion 78). FIG. 7 is a graph for illustrating a relationship of the density with the signal value.

A solid line in FIG. 7 shows the relationship between the signal value and the density that are acquired in a case in which the calibration is executed using the general-purpose fixing device 8A, as an example. In this embodiment, each of the test patterns F forms only 8-gradation (level) images, and, therefore, the CPU 81 acquires the gradation characteristic corresponding to a solid line of FIG. 7 by subjecting a measurement result among the 8-gradation images of each of the test patterns F to linear interpolation.

The CPU (generating portion) 81 generates a gradation correction table so that the gradation characteristic is an ideal gradation characteristic (S1006). The generation of the gradation correction table may be newly prepared for each execution of the calibration process, and the last generated gradation correction table may also be corrected by the calibration process.

The thus-prepared gradation correction table is stored in the RAM 82. The image processing portion 84 subjects the image data, inputted to the image forming apparatus 100, to gradation correction on the basis of the gradation correction table prepared in S1006 in a subsequent image forming operation and later. The image forming portion 78 executes the image forming operation on the basis of the image data subjected to the gradation correction by the image processing portion 84.

The image data for forming the test pattern D and the test patterns F are stored in advance in the RAM 82 or the ROM 83.

As described above, accurate gradation correction can be carried out measuring the image data of the test pattern formed on the recording material P. The calibration is executed by receiving an execution instruction from the user. For example, in many cases, the calibration is carried out in a preparatory stage before the printing of a deliverable is started or during actuation of the image forming apparatus 100 when an environmental change in temperature or humidity is large.

[Recording Material and Fixing Device Used in Calibration]

In the above-described calibration, under a gradation correction condition, a sheet-like recording material P, rather than a bag-like recording material, is used. The relationship between the signal value and the density shown in FIG. 7 is different depending on a kind of the recording material P, and, therefore, it is preferable that a recording material P on a predetermined basis is used. In this embodiment, as an example, A3-sized quality paper of 80 gsm in basis weight is recommended as paper to be used in the calibration.

The general-purpose fixing device 8A is suitable for a fixing process of the recording material P including the sheet-like recording material used in the calibration.

On the other hand, in the fixing device for an envelope 8B, as described above, in order to improve the feeding property of the envelope, the pressure exerted on the nip N is set at a low value. Further, with respect to the feeding direction of the recording material P, the width of the nip N of the fixing device for an envelope 8B is narrower than the width of the nip N of the general-purpose fixing device 8A. For that reason, when the image formed on the sheet-like recording material P is fixed in a state in which the fixing device for an envelope 8B is mounted in the mounting portion 103, a force of crushing (compressing) the surface layer of the toner in the nip N is weak, and, therefore, there is a liability that a surface property of the toner is unstable.

The density of the color detected by the color sensor 150 increases or decreases depending on a fixing property (degree of melt) of the toner. Specifically, the density detected by the color sensor 150 is greater with a decreasing amount of the diffused reflection light. This diffused reflection light is influenced by a degree of light absorption by the toner and a toner surface roughness (unevenness). Specifically, the density becomes high when a light absorption amount by the toner increases. Even when the toner amount per unit area on the recording material P is the same, with an increasing degree of smoothness of the toner surface, a regular (specular) reflection component increases and a diffusion reflection component decreases, and, therefore, a detected density increases. On the other hand, even when the toner amount per unit area is the same, with an increasing degree of roughness of the toner surface, the regular reflection component decreases and the diffusion reflection component increases, and, therefore, the detected density decreases.

Accordingly, even when the toner amount per unit area on the recording material P is the same, in a case in which the toner image is fixed on the sheet-like recording material P by using the fixing device for an envelope 8B, the fixing property (degree of melt of the toner) is unstable, and, therefore, it is difficult to measure the density high accuracy.

Further, it is also difficult to use the bag-like recording material (e.g., the envelope), including a plurality of superposed sheets, in the above-described calibration. When the toner image is formed on the envelope media, in order to accurately estimate the density of the toner image, various problems exist.

Figure 9:
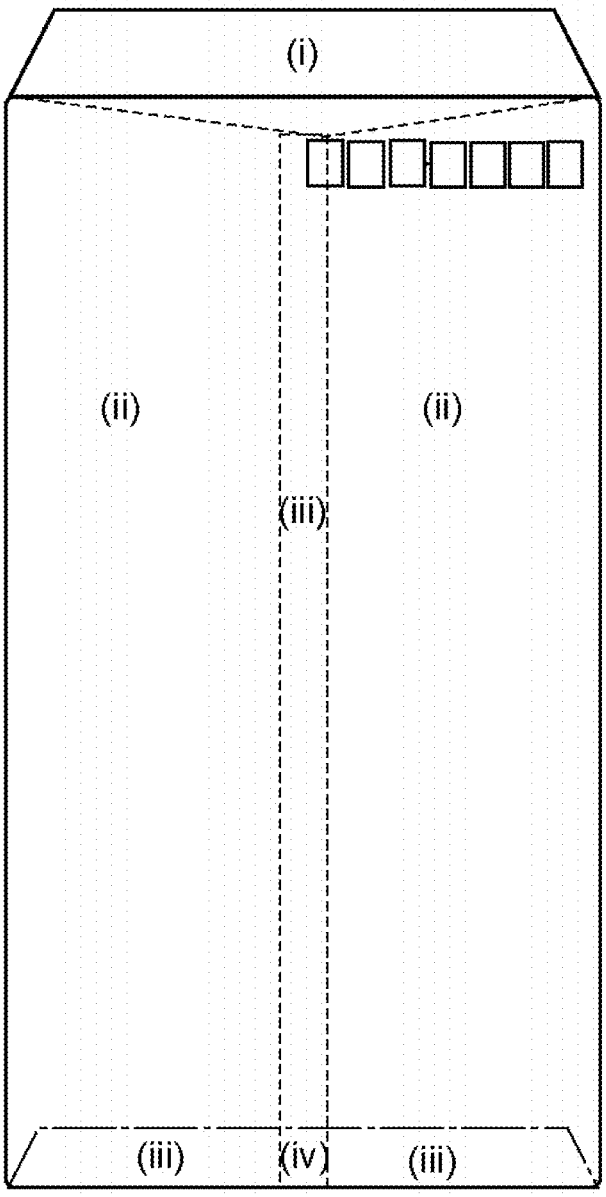
FIG. 9 is a schematic view for illustrating the number of superposed sheet of envelope media.

FIG. 9 is a schematic view for illustrating the number of superposed sheets of the envelope media and shows an example of the envelope. The envelope includes bonded portions ((iii) and (iv) in FIG. 9, for example) where sheets are bonded to each other to have a bag shape, and includes non-bonded portions ((i) and (ii) in FIG. 9, for example). Further, a thickness of each of the respective portions is different depending on the number of superposed sheets. In the example shown in FIG. 9, depending on the position, about one to about four sheets each having a thickness of about 80 μm are superposed.

For that reason, when the test pattern is formed over the portions different in the number of superposed sheets, depending on the portion where the test pattern is formed, there is a liability that the amount of the toner (toner image) transferred onto the envelope at the secondary transfer portion is different, and that a difference generates in a manner of conduction of heat and pressure to the toner in the fixing step. For example, in a case in which a test pattern including 8-gradation images is formed on the envelope, in the fixing step, there is a liability that a difference in toner fixing property generates between the gradation image(s) formed at the portion(s) where the number of superposed sheets is large and the gradation image(s) formed at another portion (or other portions). As a result, there is a liability that the density of the test pattern formed on the envelope cannot be accurately measured and thus, it is difficult to perform smooth gradation correction.

In FIG. 9, an example of the envelope was shown, but there are various kinds of envelopes different in position of bonded portion(s) and the number of superposed sheets. For example, as regards rectangular and elongated envelopes, "center bonding" (FIG. 9) including a bonded portion at a central portion of the envelope, and "side bonding" including the bonded portion at one end portion of the envelope exist. Further, as regards a side-opening (Western-style) envelope, "straw-bag bonding", including bonded portions at both end portions of the envelope, and "diagonal bonding" including a triangle flap and a diagonal bonded portion exist. These envelopes are different in thickness of the roller depending on the position of the bonded portion. For this reason, it is also difficult to form the test pattern at a position avoiding the positions where the number of superposed sheets is different.

As described above, when the calibration is executed using the fixing device for an envelope 8B, it is assumed that a measurement error of the density increases and a gradation correction condition with satisfactory accuracy cannot be determined. When actual image formation is effected using the gradation correction table prepared using the fixing device for an envelope 8B, there arises a liability that the density of the image on the outputted recording material P with respect to the inputted signal is largely different in comparison with the case of the general-purpose fixing device 8A.

Therefore, the image forming apparatus 100 in this embodiment prohibits execution of the calibration of the gradation correction condition by using the fixing device for an envelope 8B. As a result, in the image forming apparatus 100 in which a plurality of fixing devices different in pressure exerted on the nip can be used in a replaceable manner, it is possible to suppress a lowering in accuracy of the gradation correction.

Further, in a case in which the image is formed using the fixing device for an envelope 8B (for example, in a case in which a print job is executed using the fixing device for an envelope 8B), the image processing portion 84 corrects the image data inputted using the gradation correction condition subjected to the calibration by using the general-purpose fixing device 8A. As a result, in the image forming apparatus 100 in which the fixing device for an envelope 8B and the general-purpose fixing device 8A can be used in the replaceable manner, the lowering in gradation correction accuracy can be suppressed.

The calibration of the gradation correction condition in this embodiment is executed using the general-purpose fixing device 8A capable of fixing the toner (toner image) on the sheet-like recording material P with a stable fixing property. The image forming apparatus 100 in this embodiment permits (allows) execution of the calibration of the gradation correction condition by using the general-purpose fixing device 8A. As a result, it is possible to generate the gradation correction condition in which a density fluctuation generated due to the image forming portion 78 (stations Pa to Pd and the secondary transfer portion) depending on the state of the developer in the developing device 1*a*, and the temperature and the humidity in the image forming apparatus 100. That is, the calibration of the gradation correction condition in this embodiment suppresses the lowering in accuracy of the gradation correction by suppressing the density fluctuation generated due to the image forming portion 78.

[Execution of Calibration]

In this embodiment, in a case in which the fixing device 8 mounted in the mounting portion 103 is the general-purpose fixing device 8A, the CPU 81 places an execution key of the condition in an input-enable state. On the other hand, in a case in which the fixing device 8 mounted in the mounting portion 103 is the fixing device for an envelope 8B, the CPU 81 places the execution key of the calibration process in an input-disable state.

Figure 10:
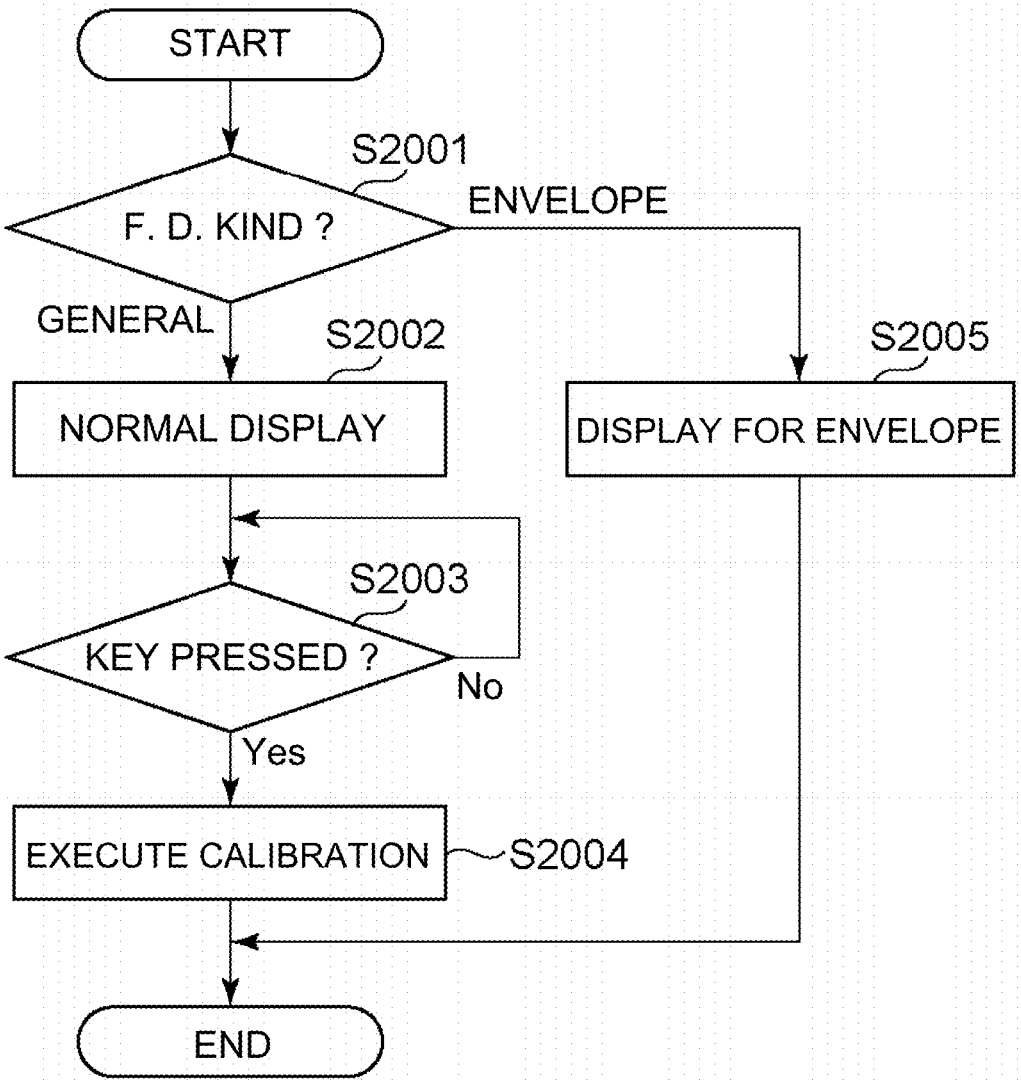
FIGS. 10 to 14 are flowcharts each regarding execution of a calibration process.

FIG. 10 is a flowchart showing the execution of the calibration process.

When the operating portion (receiving portion) 95 receives an instruction to display a screen to which an instruction of the calibration is inputted by the operator, the CPU 81 starts the flowchart shown in FIG. 10. The CPU 81 discriminates the kind of the fixing device 8 mounted in the mounting portion 103 (S2001).

Figure 15:
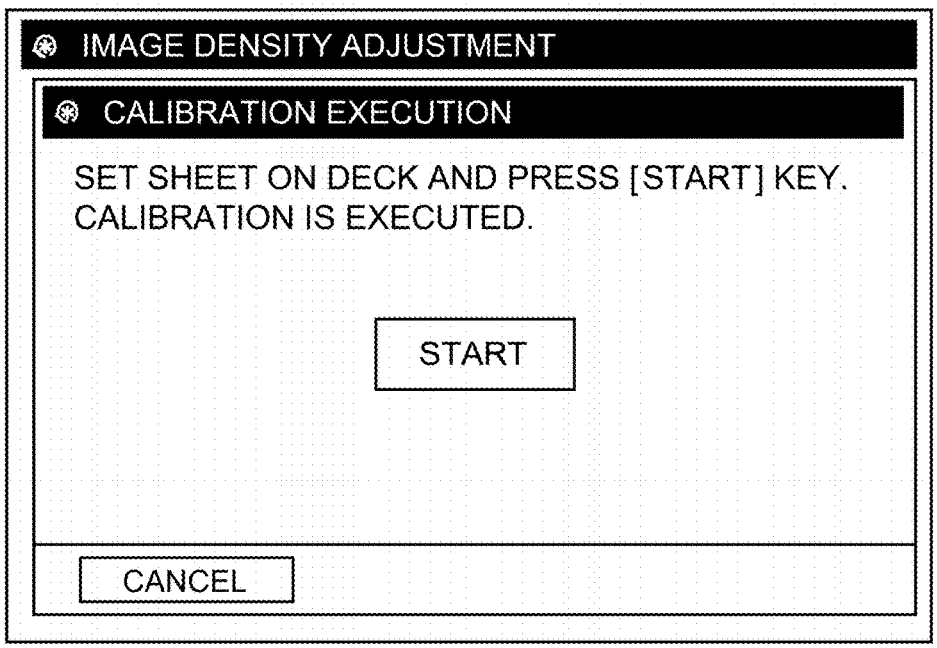

In a case in which the general-purpose fixing device 8A is mounted in the mounting portion 103, the CPU 81 causes the display portion 94 to display a screen as shown in FIG. 15 (S2002). On the screen displayed in S2002, a start key (execution key) is displayed so that the operator can input the execution instruction of the calibration. When the start key is pressed (Yes of S2003), the CPU 81 executes the calibration (FIG. 8) (S2004).

Figure 16:
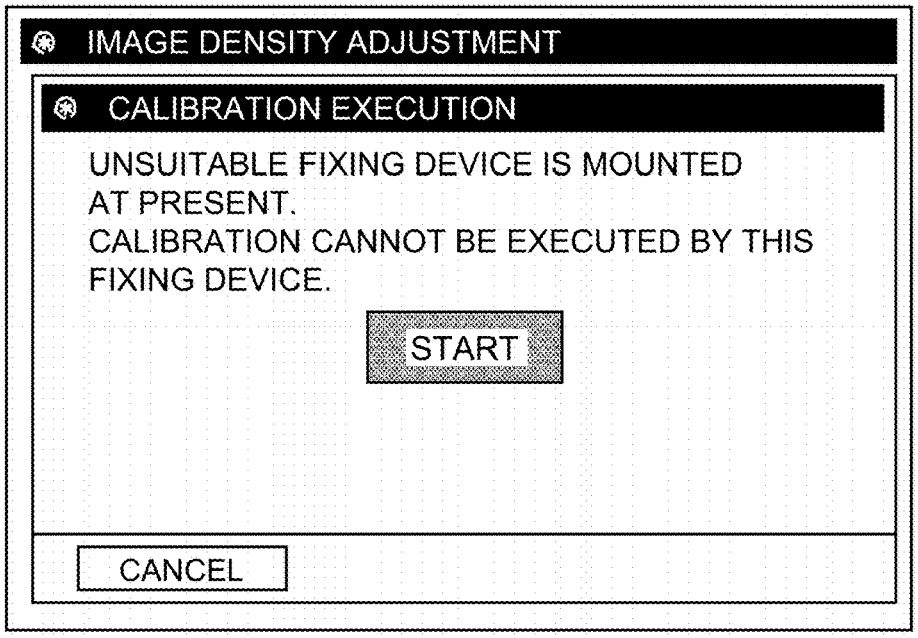

On the other hand, in S2001, in a case in which the fixing device for envelope 8B is mounted in the mounting portion 103, the CPU 81 causes the display portion 94 to display a screen as shown in FIG. 16 (S2005), and ends the flow without executing the calibration. On the screen displayed in S2005, in order to prevent the operator from inputting the execution instruction of the calibration, the start key is grayed out (in a state in which the execution instruction is not inputted even when the start key is pressed). On the screen displayed in S2005, a constitution in which the start key in FIG. 16 or a screen (input screen) is not displayed so that the operator cannot input the execution instruction of the calibration may also be employed. Further, in S2005, a constitution in which a message to the effect that the calibration cannot be executed using the currently mounted fixing device 8 is notified to the operator may also be employed.

Embodiment 2

In Embodiment 1, the constitution in which, if the fixing device for an envelope 8B is mounted in the mounting portion 103, the execution of the calibration using the fixing device for an envelope 8B is prohibited by the gray-out (input prohibition) or non-display of the start key corresponding to the execution instruction of the calibration was employed.

Figure 11:
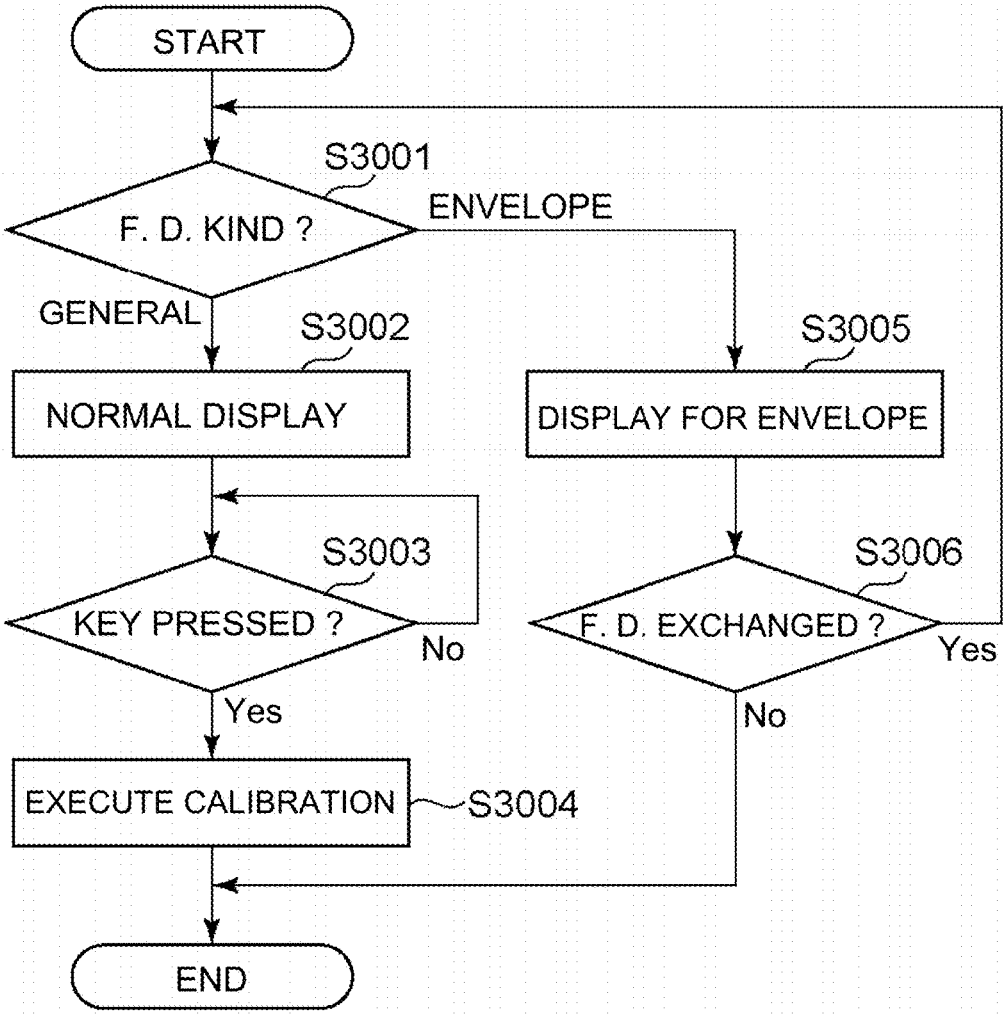

The image forming apparatus 100 in this embodiment carries out a flowchart shown in FIG. 11 in place of the flowchart of FIG. 10 in Embodiment 1. Other constitutions are similar to those in Embodiment 1, and, therefore, will be omitted from detailed description.

In this embodiment, in a case in which the fixing device for an envelope 8B is mounted in the mounting portion 103, a screen similar to the screen in S2005 in Embodiment 1 is displayed. Thereafter, when the fixing device 8 mounted in the mounting portion 103 is exchanged, a screen to which the execution instruction of the calibration is inputted is automatically displayed.

[Execution of Calibration]

FIG. 11 is a flowchart regarding execution of the calibration process in this embodiment.

S3001 to S3004 are similar to S2001 to S2004 (FIG. 10), respectively, and, therefore, will be omitted from description.

In S3001, in a case in which the fixing device for an envelope 8B is mounted in the mounting portion 103, the CPU 81 causes the display portion 94 to display the screen as shown in FIG. 16 (S3005). The screen displayed in S3005 is similar to the screen displayed in S2005 (FIG. 10), and, therefore, will be omitted from description. In a case in which, in a state in which the screen shown in FIG. 16 is displayed, opening of the front door 102 is detected on the basis of the opening/closing sensor 76, the CPU 81 discriminates that there is a possibility that the fixing device 8 is exchanged (Yes of S3006), the sequence (flow) is returned to S3001. The CPU 81 discriminates the kind of the fixing device 8 mounted in the mounting portion 103 and causes the display portion to automatically display the screen (FIG. 15 or FIG. 16) depending on the kind of the fixing device 8 mounted in the mounting portion 103. On the other hand, in S3006, in a case in which the front door 102 is not opened over a predetermined time or in a case in which a cancel key is selected on the screen of FIG. 16, the CPU 81 ends the flow of FIG. 11 without executing the calibration.

Also, in the constitution of this embodiment, the image forming apparatus 100 prohibits execution of the calibration of the gradation correction condition by using the fixing device for an envelope 8B. As a result, in the image forming apparatus 100 in which a plurality of fixing devices 8 different in pressure exerted on the nip can be used in a replaceable manner, it is possible to suppress a lowering in accuracy of the gradation correction.

Further, in a case in which the image is formed using the fixing device for an envelope 8B (for example, in a case in which a print job is executed using the fixing device for an envelope 8B), the image processing portion 84 corrects the image data inputted using the gradation correction condition subjected to the calibration by using the general-purpose fixing device 8A. As a result, in the image forming apparatus 100 in which the fixing device for an envelope 8B and the general-purpose fixing device 8A can be used in the replaceable manner, the lowering in gradation correction accuracy can be suppressed.

Embodiment 3

Figure 12:
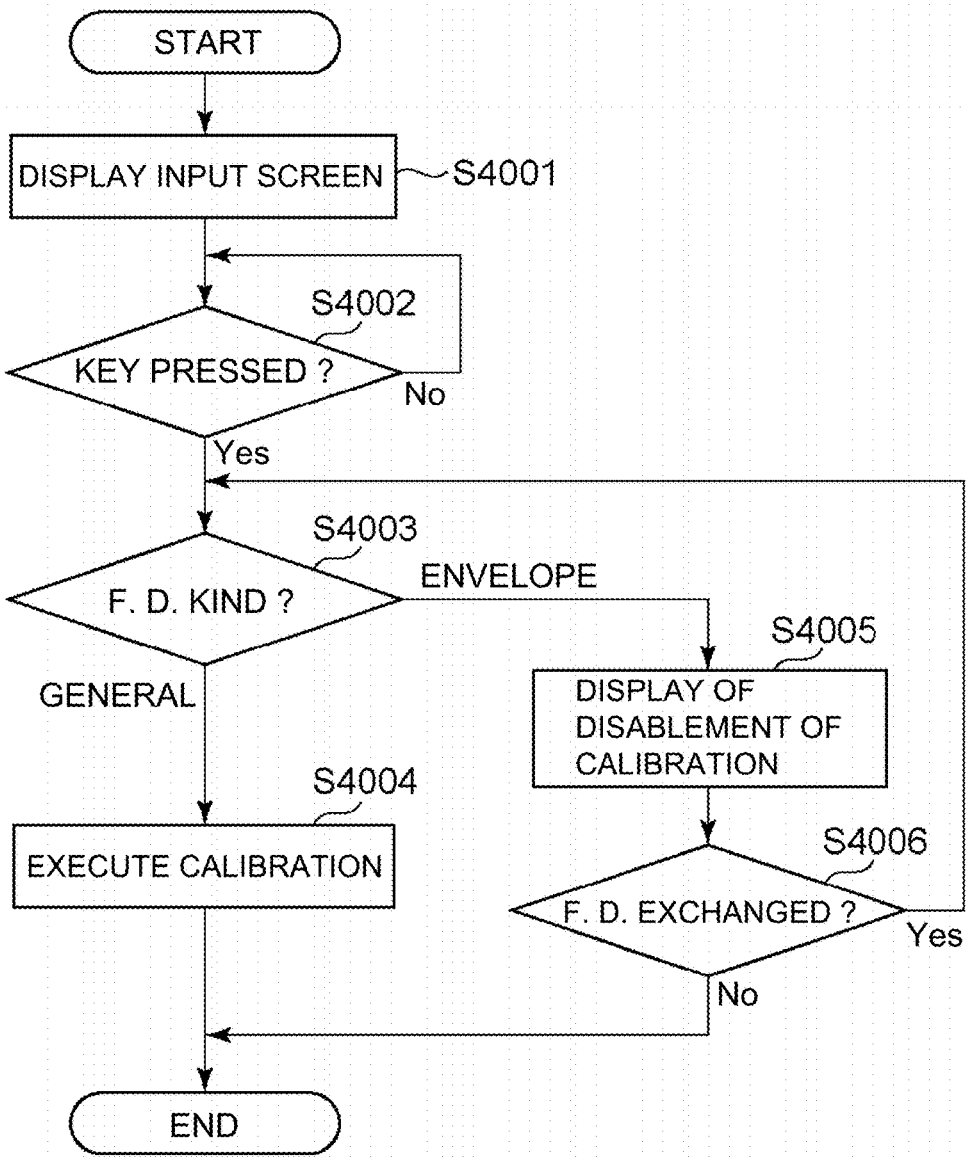
Figure 13:
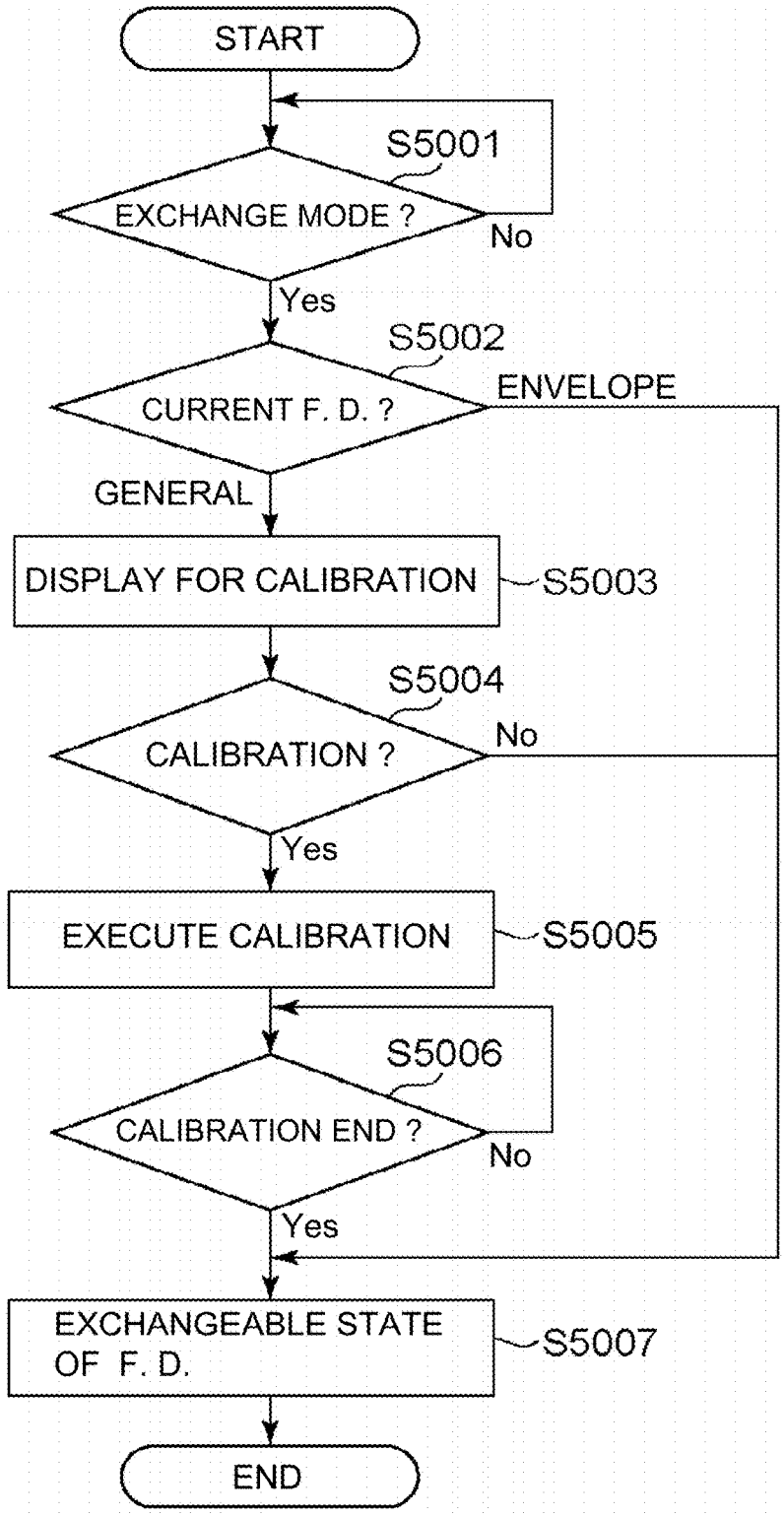
Figure 14:
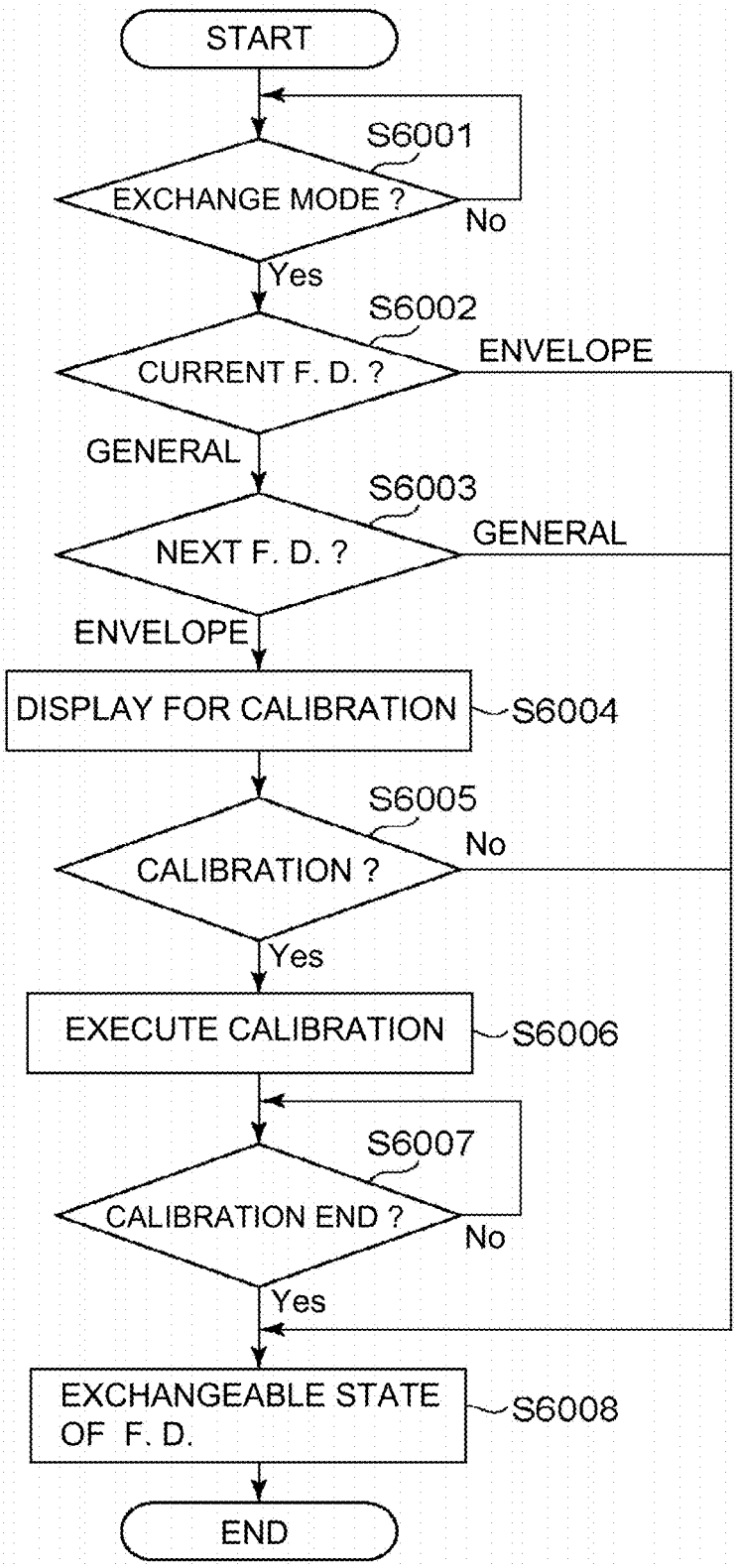

The image forming apparatus 100 in this embodiment carries out a flowchart shown in FIG. 12 in place of the flowchart of FIG. 10 in Embodiment 1. Other constitutions are similar to those in Embodiment 1, and, therefore, will be omitted from detailed description.

In this embodiment, irrespective of the fixing device 8 mounted in the mounting portion 103, the operator can input the execution instruction of the calibration. In a case in which the fixing device for an envelope 8B is mounted in the mounting portion 103, an error is displayed after the execution instruction of the calibration is inputted.

[Execution of Calibration]

FIG. 12 is a flowchart regarding execution of the calibration process in this embodiment.

When an instruction to display a screen to which the instruction of the calibration is inputted by the operator through the operating portion 95 is received by the CPU 81, the CPU 81 starts the flow shown in FIG. 12, and the CPU 81 causes the display portion 94 to display the screen as shown in FIG. 15 (S4001). The screen displayed in S4001 is similar to the screen displayed in S2005 (FIG. 10), and, therefore, will be omitted from description.

When the start key is pressed (Yes of S4002), the CPU 81 discriminates the kind of the fixing device 8 mounted in the mounting portion 103 (S4003).

In a case in which the general-purpose fixing device 8A is mounted in the mounting portion 103, the CPU 81 executes the calibration (FIG. 8) (S4004).

On the other hand, in a case in which the fixing device for envelope 8B is mounted in the mounting portion 103, the CPU 81 causes the display portion (notifying portion) 94 to display a screen as shown in FIG. 17 (S4005). In S4005, the CPU 81 notifies the operator of disablement of the execution of the calibration by using the currently mounted fixing device 8, through the display on the screen shown in FIG. 17. As a result, the operator can know that the calibration cannot be executed. In a case in which, in a state in which the screen shown in FIG. 17 is displayed, opening of the front door 102 is detected on the basis of the opening/closing sensor 76, the CPU 81 discriminates that there is a possibility that the fixing device 8 is exchanged (Yes of S4006), the sequence (flow) is returned to S4003. On the other hand, in a case in which the front door 102 is not opened over a predetermined time or in a case in which a cancel key is selected on the screen of FIG. 17, the CPU 81 ends the flow of FIG. 12 without executing the calibration.

The screen shown at the display portion 94 in S4005 by the CPU 81 may also be a screen as shown in FIG. 18. That is, by the display of the screen shown in FIG. 18, a constitution in which not only the operator is notified of the disablement of the execution of the calibration by using the currently mounted fixing device but also the user is inquired of whether or not the fixing device 8 should be exchanged may also be employed. In this case, when the exchange of the fixing device 8 is selected, the flow is returned to S4003 by the CPU 81, and, when the stop is selected, the CPU 81 ends the flow of FIG. 12 without executing the calibration process.

Also, in the constitution of this embodiment, the image forming apparatus 100 prohibits execution of the calibration of the gradation correction condition by using the fixing device for an envelope 8B. As a result, in the image forming apparatus 100 in which a plurality of fixing devices 8 different in pressure exerted on the nip N can be used in a replaceable manner, it is possible to suppress a lowering in accuracy of the gradation correction.

In a case in which the image is formed using the fixing device for an envelope 8B (for example, in a case in which a print job is executed using the fixing device for an envelope 8B), the image processing portion 84 corrects the image data inputted using the gradation correction condition subjected to the calibration by using the general-purpose fixing device 8A. As a result, in the image forming apparatus 100 in which the fixing device for an envelope 8B and the general-purpose fixing device 8A can be used in the replaceable manner, the lowering in gradation correction accuracy can be suppressed.

Embodiment 4

In this embodiment, a constitution in which, in a case in which the operator exchanges the fixing device 8 mounted in the mounting portion 103, the operator selects an operation in an exchange mode through the operating portion 95. In a case in which the fixing device 8 is exchanged from a state in which the general-purpose fixing device 8A is mounted, the image forming apparatus 100 prompts the operator to execute the calibration before the exchange of the fixing device 8.

The image forming apparatus 100 in this embodiment carries out a flowchart shown in FIG. 3 in addition to the constitutions of Embodiments 1 to 3.

[Execution of Calibration]

In a case in which the exchange of the fixing device 8 is carried out, the operator selects the exchange mode through the operating portion 95. When the CPU 81 receives the input of the exchange mode through the operating portion (exchange information input portion) 95 (Yes of S5001), the CPU 81 discriminates the kind of the fixing device 8 currently mounted in the mounting portion 103 (S5002).

In a case in which the fixing device for an envelope 8B is mounted in the mounting portion 103, the flow executed by the CPU 81 goes to S5007.

Figure 19:
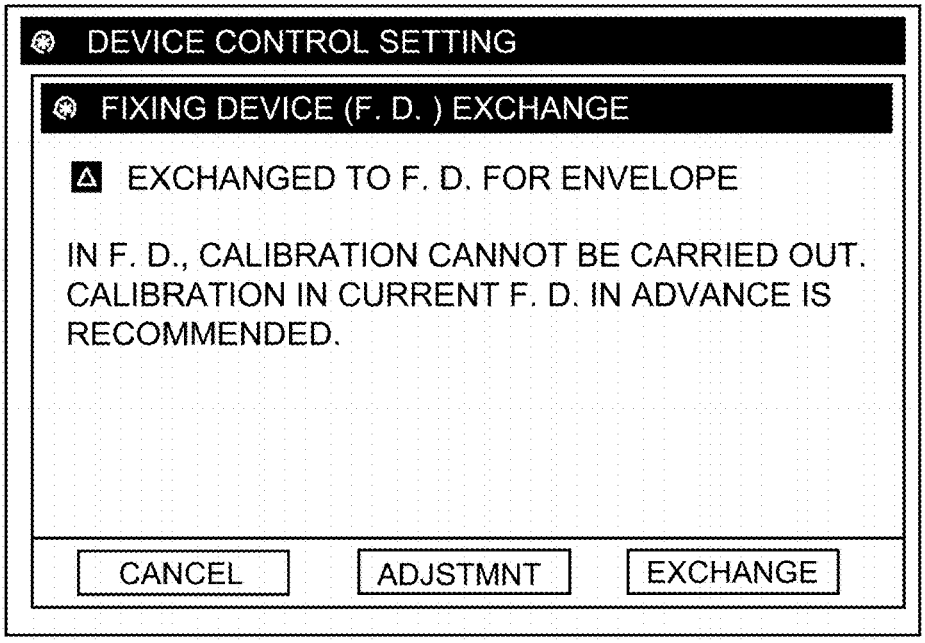

In a case in which the general-purpose fixing device 8A is mounted in the mounting portion 103, the CPU 81 causes the display portion 94 to display a screen as shown in FIG. 19 (S5003). In S5003, the CPU 81 recommends the operator to execute the calibration by using the general-purpose fixing device 8A in advance of the exchange of the fixing device 8, through the display on the screen shown in FIG. 19. As a result, the operator can select whether the calibration is executed in advance of the exchange of the fixing device 8 or the fixing device 8 is exchanged without executing the calibration. Further, the CPU 81 also notifies the operator that the calibration cannot be executed using the fixing device for an envelope 8B, on the screen of FIG. 19. As a result, the operator who intends to exchange the fixing device 8 to the fixing device for an envelope 8B, with which the execution of the calibration is prohibited, is capable of executing the calibration before the exchange as desired. Consequently, the operator can save time and effort to mount the general-purpose fixing device 8A again for executing the calibration immediately after the exchange to the fixing device for an envelope 8B.

On the screen of FIG. 19, when the operator inputs information indicating that the calibration is not executed (i.e., selects an exchange execution key) (No of S5004), the CPU 81 does not execute the calibration, and the flow goes to S5007.

On the screen of FIG. 19, when the operator selects the execution of the calibration (Yes of S5004), the CPU 81 executes the calibration (FIG. 8) (S5005). When the calibration is completed (Yes of S5006), the flow goes to S5007.

Figure 20:
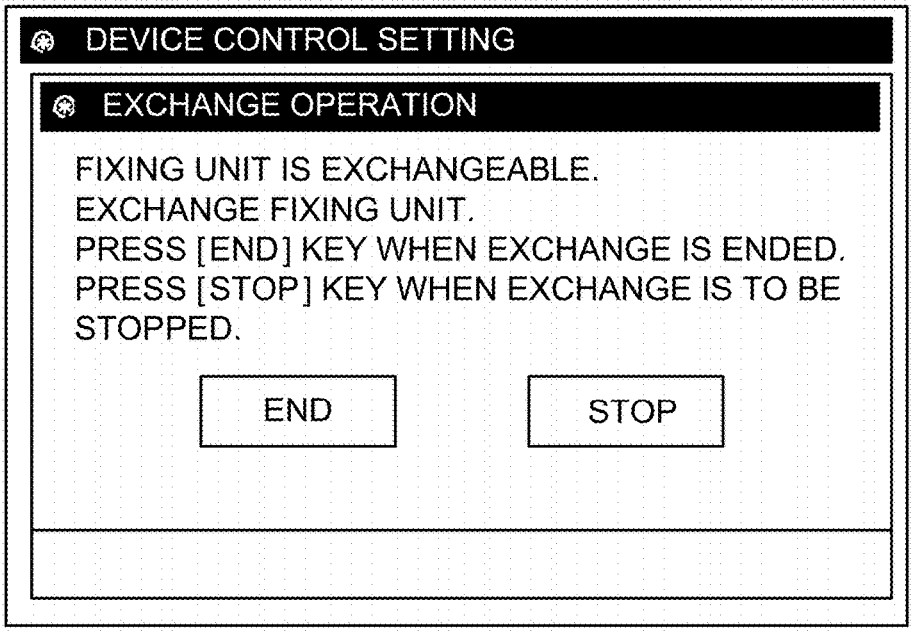

In S5007, the CPU 81 causes the display portion 94 to display a screen as shown in FIG. 20, and thus notifies the operation that the fixing device 8 is exchangeable.

Embodiment 5

In this embodiment, a constitution in which, in a case in which the operator exchanges the fixing device 8 mounted in the mounting portion 103, the operator selects an operation in an exchange mode through the operating portion 95. In a case in which the general-purpose fixing device 8A is exchanged to the fixing device for an envelope 8B, the image forming apparatus 100 prompts the operator to execute the calibration before the exchange of the fixing device 8.

The image forming apparatus 100 in this embodiment carries out a flowchart shown in FIG. 4 in addition to the constitutions of Embodiments 1 to 3.

[Execution of Calibration]

Figure 21:
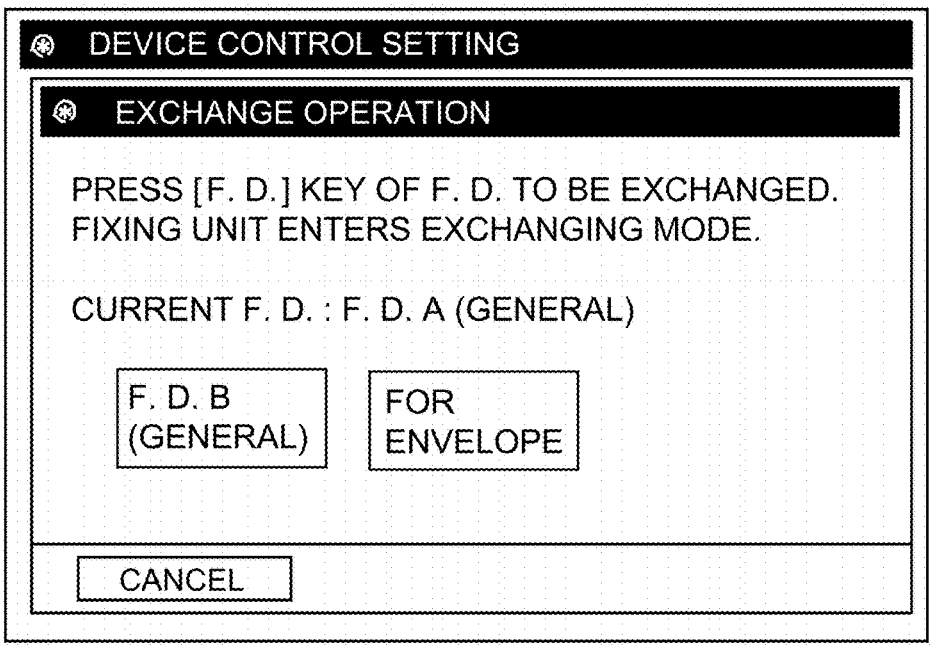

In a case in which the exchange of the fixing device 8 is carried out, the operator selects the exchange mode through the operating portion 95. At that time, the CPU 81 causes the display portion 94 to display a screen shown in FIG. 21, and prompts the operator to input information corresponding to the kind of the fixing device 8 to be mounted after the exchange. When the CPU 81 receives the input of the exchange mode through the operating portion 95 (Yes of S6001), the CPU 81 discriminates the kind of the fixing device 8 currently mounted in the mounting portion 103 (S6002).

In a case in which the fixing device for an envelope 8B is mounted in the mounting portion 103, the flow executed by the CPU 81 goes to S6008.

Figure 22:
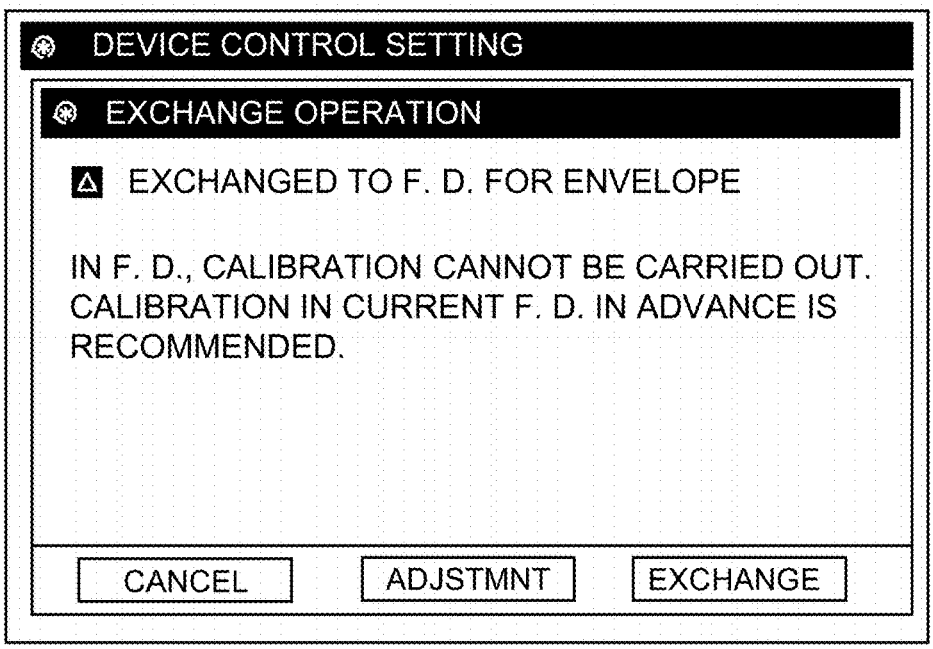

In a case in which the general-purpose fixing device 8A is mounted in the mounting portion 103, the CPU 81 discriminates the kind of the fixing device 8 after the exchange on the basis of the information inputted in S6001 (S6003). In a case in which the fixing device 8 mounted after the exchange is the fixing device for an envelope 8B, the CPU 81 causes the display portion 94 to display a screen as shown in FIG. 22 (S6004). In S6004, the CPU 81 recommends the operator to execute the calibration by using the general-purpose fixing device 8A in advance of the exchange of the fixing device 8 to the fixing device for an envelope 8B, through the display on the screen shown in FIG. 22. As a result, the operator who intends to exchange the fixing device 8 to the fixing device for an envelope 8B with which the execution of the calibration is prohibited is capable of executing the calibration before the exchange as desired. Consequently, the operator can save time and effort to mount the general-purpose fixing device 8A again for executing the calibration immediately after the exchange to the fixing device for an envelope 8B.

On the screen of FIG. 22, when the operator inputs information indicating that the calibration is not executed (i.e., selects an exchange execution key) (No of S6005), the flow executed by the CPU 81 goes to S6008.

On the screen of FIG. 22, when the operator selects the execution of the calibration (Yes of S6005), the CPU 81 executes the calibration (FIG. 8) (S6006). When the calibration is completed (Yes of S6007), the flow goes to S6008.

In S6008, the CPU 81 causes the display portion 94 to display a screen as shown in FIG. 20, and thus, notifies the operation that the fixing device 8 is exchangeable.

In Embodiments 1 to 5, a constitution in which the color sensor 150 is provided in the image forming apparatus 100 and the color of the test pattern formed on the recording material P is measured by the color sensor 150 in the calibration of the gradation correction condition is employed.

In this embodiment, a constitution in which in the calibration of the gradation correction condition, in place of the color sensor 150, the scanner portion 30 reads the recording material P on which the test pattern is formed and the original reading portion of the scanner portion 30 measures the color of the test pattern is employed. In this case, the test pattern is fixed using the general-purpose fixing device 8A, and, depending on discharge of the recording material P, the CPU 81 prompts the operator to place the recording material P, on which the test pattern is formed, on the original carriage 300 of the scanner portion 30. For example, the CPU 81 causes the display portion 94 of the operating portion 95 to display a massage to that effect.

Other constitutions are similar to those of Embodiments 1 to 5, and, therefore, will be omitted from description. That is, in each of Embodiments 1 to 5, as regards the member for measuring the color of the test pattern in the calibration, the member is understood by reading the color sensor 150 as the scanner portion 30.

Embodiment 7

In Embodiments 1 to 6 described above, a constitution of the roller fixing type fixing device, in which the nip N is formed by the fixing roller 40 and the pressing roller 41, was employed, but of the pair of rotatable members for forming the nip N, at least one thereof may also be a belt rotatable member stretched by a plurality of rollers. Further, both of the pair of rotatable members for forming the nip N may also be belt rotatable members each stretched by a plurality of rollers.

Other Embodiments

In the above-described embodiments, an example in which the execution of the calibration of the gradation correction condition by using the fixing device for an envelope 8B is prohibited by prohibiting the input of the execution instruction of the calibration or by generating the error in response to the input of the execution instruction of the calibration was described. In the image forming apparatus 100 to which the plurality of kinds of fixing devices 8, including the fixing device for an envelope 8B, are detachably mountable, prohibition of the execution of the calibration of the gradation correction condition by using the fixing device for envelope 8B includes the following three cases. Also in the following three cases, the calibration of the gradation correction condition by using the fixing device for an envelope 8B is not executed, and, therefore, in the image forming apparatus in which the plurality of fixing devices different in pressure exerted on the nip can be used in a replacing manner, a lowering in accuracy of the gradation correction can be suppressed.

(1) The first case is such that the execution of the calibration of the gradation correction condition by using the fixing device for an envelope 8B is prohibited by preventing the test pattern for the calibration from being formed by the image forming portion 78 in a state in which the fixing device for an envelope 8B is mounted in the mounting portion 103. The prevention of the test pattern for the calibration from being formed by the image forming portion 78 includes a case in which the latent image corresponding to the test pattern is prevented from being formed by the exposure portion and a case in which the latent image corresponding to the test pattern is formed by the exposure portion, but the test pattern is prevented from being transferred onto the recording material P by the transfer portion.

(2) The second case is such that the test pattern for the calibration is formed by the image forming portion 78 and is fixed on the recording material P by the fixing device for an envelope 8B, but the execution of the calibration of the gradation correction condition by using the fixing device for an envelope 8B is prohibited by preventing detection of the density by the detecting portion. The density of the test pattern fixed using the fixing device for an envelope 8B is not detected, and, therefore, the gradation correction condition is not subjected to the calibration by using the fixing device for an envelope 8B.

(3) The third case is such that the test pattern for the calibration is formed by the image forming portion 78 and is fixed on the recording material P by the fixing device for envelope 8B, and then the density is detected by the detecting portion, but the generation of the gradation correction condition by the CPU 81 is not carried out. The gradation correction condition is not generated using a detection result of the density of the test pattern fixed using the fixing device for an envelope 8B. That is, the gradation correction condition is not subjected to the calibration by using the fixing device for envelope 8B.

These cases can include a disadvantage, however, such that, in order to form a test pattern that is not used for the calibration in actuality, the toner is consumed and the recording material P is consumed. Accordingly, in a preferred example, a constitution in which the formation of the latent image corresponding to the test pattern for the calibration is not started in the state in which the fixing device for an envelope 8B is mounted in the mounting portion 103.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a correcting portion configured to correct gradation of inputted image data on the basis of a correction condition;

an image forming device configured to form, on a recording material, a toner image corresponding to the image data corrected by said correcting portion;

a mounting portion, wherein a first fixing device includes a pair of rotatable members forming a first nip under a first load and configured to fix, on the recording material in the first nip, the toner image formed by said image forming device, said first fixing device being mountable in said mounting portion so as to be replaceable with a second fixing device including a pair of rotatable members forming a second nip under a second load that is less than the first load and configured to fix, on the recording material in the second nip, the toner image formed by said image forming device;

an executing portion configured to execute an output process for forming and outputting, on the recording material, a predetermined toner image for generating the correction condition, wherein the predetermined toner image includes a plurality of image regions different in density;

an input portion configured to permit input of an execution instruction of the output process by an operator; and a controller configured to control notification of information to the operator, wherein said controller provides a notification prompting exchange of said second fixing device in a case that the execution instruction of the output process is inputted to said input portion when said second fixing device is mounted in said mounting portion, and permits execution of the output process in a case that the execution instruction of the output process is inputted to said input portion when said first fixing device is mounted in said mounting portion.

2. An image forming apparatus according to claim 1, further comprising a display portion, wherein, in the case that the execution instruction of the output process is inputted to said input portion when said second fixing device is mounted in said mounting portion, said controller causes said display portion to display, as the notification, information prompting the exchange of said second fixing device.

3. An image forming apparatus according to claim 1, further comprising a display portion, wherein, in the case that the execution instruction of the output process is inputted to said input portion when said second fixing device is mounted in said mounting portion, said controller causes said display portion to display, as the notification, information indicating that execution of the output process is undesirable.

4. An image forming apparatus according to claim 1, wherein, in the case that the execution instruction of the output process is inputted to said input portion when said first fixing device is mounted in said mounting portion, in the output process, said controller causes said first fixing device to fix the predetermined toner image, formed by said image forming portion on the recording material, on the recording material, and then causes said executing portion to output the recording material on which the predetermined toner image is fixed by said first fixing device.

5. An image forming apparatus according to claim 1, wherein, in the case that the execution instruction of the output process is inputted to said input portion when said second fixing device is mounted in said mounting portion, said executing portion executes the output process is response to mounting of said first fixing device in said mounting portion.

6. An image forming apparatus according to claim 1, wherein, when said second fixing device is mounted in said mounting portion, said controller prohibits execution of the output process.

7. An image forming apparatus according to claim 1, wherein said first fixing portion includes a first storing portion configured to store information indicating said first fixing device, wherein said second fixing device includes a second storing portion configured to store information indicating said second fixing device, and wherein said image forming apparatus further comprises an acquiring portion configured to acquire the information stored in one of the first storing portion of said first fixing device and the second storing portion of said second fixing device stored in said mounting portion.

8. An image forming apparatus according to claim 1, further comprising a detector configured to detect a density of an image fixed on the recording material, wherein, in the output process, said executing portion causes said detector to detect a density of the predetermined toner image formed and fixed on the recording material, and then generates the correction condition on the basis of a result of detection by said detector.

9. An image forming apparatus according to claim 1, further comprising a reading portion configured to read an image of an original, wherein, when the output process is executed, said executing portion prompts the operator so as to cause said reading portion to read the predetermined toner image carried on the recording material outputted by the output process, and then generates the correction condition on the basis of a result of reading by said reading portion.

10. An image forming apparatus comprising:

a correcting portion configured to correct gradation of inputted image data on the basis of a correction condition;

an image forming device configured to form, on a recording material, a toner image corresponding to the image data corrected by said correcting portion;

a mounting portion, wherein a first fixing device configured to fix the toner image on a predetermined type of a recording material, not including a predetermined envelope, is mountable in said mounting portion so as to be replaceable with a second fixing device configured to fix the toner image on a predetermined type of a recording material, including the predetermined envelope;

an executing portion configured to execute an output process for forming and outputting, on the recording material, a predetermined toner image for generating the correction condition, wherein the predetermined toner image includes a plurality of image regions different in density;

an input portion configured to permit input of an execution instruction of the output process by an operator; and a controller configured to control notification of information to the operator, wherein said controller provides a notification prompting exchange of said second fixing device in a case that the execution instruction of the output process is inputted to said input portion when said second fixing device is mounted in said mounting portion, and permits execution of the output process in a case that the execution instruction of the output process is inputted to said input portion when said first fixing device is mounted in said mounting portion.

11. An image forming apparatus according to claim 10, further comprising a display portion, wherein, in the case that the execution instruction of the output process is inputted to said input portion when said second fixing device is mounted in said mounting portion, said controller causes said display portion to display, as the notification, information prompting the exchange of said second fixing device.

12. An image forming apparatus according to claim 10, further comprising a display portion, wherein, in the case that the execution instruction of the output process is inputted to said input portion when said second fixing device is mounted in said mounting portion, said controller causes said display portion to display, as the notification, information indicating that execution of the output process is undesirable.

13. An image forming apparatus according to claim 10, wherein, in the case that the execution instruction of the output process is inputted to said input portion when said first fixing device is mounted in said mounting portion, in the output process, said controller causes said first fixing device to fix the predetermined toner image, formed by said image forming portion on the recording material, on the recording material, and then causes said executing portion to output the recording material on which the predetermined toner image is fixed by said first fixing device.

14. An image forming apparatus according to claim 10, wherein, in the case that the execution instruction of the output process is inputted to said input portion when said second fixing device is mounted in said mounting portion, said executing portion executes the output process is response to mounting of said first fixing device in said mounting portion.

15. An image forming apparatus according to claim 10, wherein, when said second fixing device is mounted in said mounting portion, said controller prohibits execution of the output process.

16. An image forming apparatus according to claim 10, wherein said first fixing portion includes a first storing portion configured to store information indicating said first fixing device, wherein said second fixing device includes a second storing portion configured to store information indicating said second fixing device, and wherein said image forming apparatus further comprises an acquiring portion configured to acquire the information stored in one of the first storing portion of said first fixing device and the second storing portion of said second fixing device stored in said mounting portion.

17. An image forming apparatus according to claim 10, further comprising a detector configured to detect a density of an image fixed on the recording material, wherein, in the output process, said executing portion causes said detector to detect a density of the predetermined toner image formed and fixed on the recording material, and then generates the correction condition on the basis of a result of detection by said detector.

18. An image forming apparatus according to claim 10, further comprising a reading portion configured to read an image of an original, wherein, when the output process is executed, said executing portion prompts the operator so as to cause said reading portion to read the predetermined toner image carried on the recording material outputted by the output process, and then generates the correction condition on the basis of a result of reading by said reading portion.

* * * * *